US007039347B2

(12) United States Patent
Yamada et al.

(10) Patent No.: US 7,039,347 B2
(45) Date of Patent: May 2, 2006

(54) TONER SUPPLY CONTAINER AND IMAGE FORMING APPARATUS

(75) Inventors: Yusuke Yamada, Ibaraki-ken (JP); Yutaka Ban, Tokyo (JP); Fumio Tazawa, Abiko (JP); Hironori Minagawa, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 241 days.

(21) Appl. No.: 10/076,455

(22) Filed: Feb. 19, 2002

(65) Prior Publication Data

US 2002/0122676 A1 Sep. 5, 2002

(30) Foreign Application Priority Data

Feb. 19, 2001 (JP) ..... 2001/042536
Jun. 8, 2001 (JP) ..... 2001/174179

(51) Int. Cl.
*G03G 15/08* (2006.01)

(52) U.S. Cl. ..... 399/263

(58) Field of Classification Search ..... 399/119, 399/120, 252, 254, 256, 257, 262, 263; 222/DIG. 1
See application file for complete search history.

(56) References Cited

U.S. PATENT DOCUMENTS 5,508,792 A 4/1996 Ishida et al. ..... 399/256
5,579,101 A 11/1996 Omata et al. ..... 399/114
5,890,040 A 3/1999 Matsuoka et al. ..... 399/262
6,131,008 A * 10/2000 Kanamori et al. ..... 399/263
6,185,401 B1 * 2/2001 Kanamori et al. ..... 399/262
6,266,505 B1 * 7/2001 Ban et al. ..... 399/258
6,314,261 B1 11/2001 Omata et al. ..... 399/258
6,704,533 B1 * 3/2004 Isomura et al. ..... 399/254
2002/0106215 A1 * 8/2002 Ban et al. ..... 399/120

FOREIGN PATENT DOCUMENTS

| | | |
|---|---|---|
| CN | 1119752 A | 4/1996 |
| JP | 7-44000 | 2/1995 |
| JP | 7-104572 | 4/1995 |
| JP | 7-113796 | 5/1995 |
| JP | 10-260574 | 9/1998 |
| JP | 10/339993 | 12/1998 |

* cited by examiner

*Primary Examiner*—Hoan Tran
(74) *Attorney, Agent, or Firm*—Fitzpatrick, Cella, Harper & Scinto

(57) ABSTRACT

A toner supply container detachably mountable to an image forming apparatus, includes a main body for accommodating toner; an opening for permitting discharge of the toner from the main body; a rotatable feeding member, provided in the main body, for feeding the toner by rotation thereof; wherein the feeding member including a lift portion for lifting the toner in the main body, a guiding portion for guiding the toner lifted by the collecting portion downwardly toward the opening, and a falling portion for letting the toner lifted by the lifting portion fall without feeding it toward the opening with rotation of the feeding member.

20 Claims, 22 Drawing Sheets

TONER SUPPLY CONTAINER AND IMAGE FORMING APPARATUS

FIELD OF THE INVENTION AND RELATED ART

The present invention relates to an image forming apparatus employing an electrophotographic image formation method or an electrostatic recording method, and a toner supply container used with such an image forming apparatus. In particular, it relates to such an image forming apparatus as a copying machine, a printer, a facsimile machine, or the like and a toner supply container used with such an image forming apparatus.

In an image forming apparatus such as an electrophotographic copying machine, a printer, or the like, microscopic powder of toner has been used as developer. As the developer in an image forming apparatus is consumed, toner is supplied to the image forming apparatus with the use of a toner supply container.

Since toner is in the form of microscopic powder, there has been the problem that during a toner supplying operation, toner scatters and contaminates an operator and the area adjacent to the apparatus. Thus, there have been made a number of proposals regarding the method for preventing this problem, and some of them have been put to practical use. According to one of such proposals, a toner supply container is placed in the main assembly of an image forming apparatus (which hereinafter will be referred to as apparatus main assembly), and the toner within the toner supply container is discharged from the container by a small amount as necessary. In the case of this method, it is difficult to reliably and naturally (relying on gravity) discharge the toner. Thus, the provision of some type of means for stirring/conveying the toner is necessary.

The toner supply container disclosed in Japanese patent Application publication 7-113796 is approximately cylindrical in general shape. It is provided with a relatively small toner outlet, which is in one of the lengthwise end walls. It is also provided with a spiral toner stirring/conveying member, which is located within the container. This spiral member is externally driven; external driving force is transmitted to one of the lengthwise ends of this spiral member extended through the corresponding lengthwise end wall of the container. The other end, that is, non-driven end, of the spiral stirring/conveying member is left free.

The toner supply container disclosed in Japanese Laid-open patent Application 7-104572 also contains a toner agitator, which has a plurality of agitating blade formed of elastic substance. In this case, the force for conveying the toner in the direction parallel to the axial direction of the container is realized by giving the agitator blades a trapezoidal shape by varying the distance from the rotational axis to the tips of the agitator blades.

One of the lengthwise ends of each of the above described two stirring member in accordance with the prior arts is extended through the container wall at one of the lengthwise ends. Thus, the portion of the container wall through which the stirring member is extended needs to be provided with a bearing/sealing mechanism of some type. As for the structure of such a bearing/sealing mechanism, which is widely in use, a gear is attached to the lengthwise end of the stirring member, and a sealing member is sandwiched between the gear and container wall. As for the sealing member, generally, a piece of wool felt, or an oil seal, in the form of a donut is used.

This type of toner container is mounted within the main assembly of an image forming apparatus. In operation, as the toner stirring/conveying member within the toner container is rotationally driven by the force transmitted from the apparatus main assembly side, the toner within the container is conveyed within the container, and then, is continuously discharge by a small amount from the toner outlet of the container as necessary.

Japanese Laid-open patent Application 7-44000 discloses another toner supply container in accordance with the prior arts. According to this application, a toner supply container is approximately in the form of a cylindrical bottle; in other words, the toner supply container has: a toner outlet portion, with the smallest diameter, equivalent to the neck portion of a bottle; a toner holding portion equivalent to the main body of a bottle, and an approach portion, in the form of a circular frustum, equivalent to the portion of a bottle connecting the neck portion and main body of a bottle. The internal surface of the main body portion is provided with a single spiral rib, or a plurality of spiral ribs, which extend from one lengthwise end of the main body to the other. The outward end of the outlet portion is provided with a hole, through which the toner is discharged. In operation, as the toner supply container is rotated, the toner therein is conveyed by the spiral ribs toward the toner outlet, is guided (or lifted) into the toner outlet by the approach portion, and then, is discharged from the outlet hole.

Japanese Laid-open patent Application 10-260574 also discloses a toner supply container in accordance with the prior arts. This toner supply container is also approximately in the form of a cylindrical bottle. In other words, it has a toner outlet portion with the smallest diameter, equivalent to the neck portion of a bottle; a toner holding portion equivalent to the main body of a bottle, and an approach portion, in the form of a circular frustum, equivalent to the portion of a bottle connecting the neck portion and main body of a bottle. The internal surface of the main body portion is provided with a single spiral rib or plurality of spiral ribs which extend from one lengthwise end of the main body the other. The outward end of the outlet portion is provided with a hole, through which the toner is discharged. This toner supply container, however, is different from the preceding one in that its approach portion comprises a portion which rakes the toner upward as the toner is conveyed thereto, and a portion which guides the toner to the toner outlet as the toner is raked upward.

The immediately preceding two toner supply containers in accordance with the prior arts are different from the other preceding two toner supply containers in accordance with the prior arts in that they do not contain a stirring member. These immediately preceding two toner supply containers are also mounted within the main assembly of an image forming apparatus. They are different in that in order to convey the toner therein, the toner supply containers themselves are rotated by the driving force from the apparatus main assembly side.

The above described toner supply containers in accordance with the prior arts, however, suffer from the following problems.

First, in the case of the toner supply containers in accordance with the prior arts disclosed in Japanese Laid-open patent Applications 7-113796 and 7-104572, the portion of the toner supply container, through which the force for driving the stirring member is received, must be provided with a bearing/sealing mechanism. This requirement increases the components count, which in turn increases the assembly time and labor, increasing therefore manufacturing cost.

Further, in the case of such a bearing/sealing mechanism as the above described one, there is a possibility that toner is drawn into the bearing/sealing portion. If toner is drawn into the bearing/sealing portion, the toner particles are likely to be melted and agglutinate into larger toner particles, which derogatorily affects image quality if they happen to contribute to image development. This is problem, although it rarely occurs.

Secondly, in the case of the toner supply containers in accordance with the prior arts disclosed in Japanese Laid-open patent Applications 7-44000 and 10-260574, the toner supply containers do not have an internal stirring member. Therefore, they do not suffer from the above described problem related to a bearing/sealing mechanism. However, they suffer from the following problems, because their internal surfaces are provided with a single spiral rib, or a plurality of spiral ribs.

Since these toner supply containers do not contain an internal stirring member or the like for stirring the toner therein, there is a possibility that if they are subjected to vibrations during their shipment, or if they are stored for a substantial length of time under high temperature/humidity condition, the toner therein agglomerates, forming the so-called toner bridges. Without the presence of a toner stirring member, once the toner bridges are formed, the toner is not efficiently discharged. More specifically, the toner bridges are conveyed, without being collapsed, toward the outlet, by the spiral ribs on the internal surface of the toner supply container, possibly plugging up the toner outlet.

SUMMARY OF THE INVENTION

The primary object of the present invention is to provide a toner supply container superior to a toner supply container in accordance with the prior arts, in both toner conveyance performance and toner stirring performance.

Another object of the present invention is to provide a toner supply container capable of unagglomerating the toner therein while conveying it.

These and other objects, features, and advantages of the present invention will become more apparent upon consideration of the following description of the preferred embodiments of the present invention, taken in conjunction with the accompanying drawings.

BRIEF DESCRIPTION OF DRAWINGS

FIGS. 7(A), 7(B), and 7(C) are perspective view, front view, and left side view, of the toner conveying member in the first embodiment of the present invention.

FIGS. 17(A), 17(8), and 17(C) are schematic sectional views of the toner supply container in the second embodiment of the present invention, which show how the toner in the container is discharged from the container, as the container is rotated in the clockwise direction.

DETAILED DESCRIPTION OF THE PREFERRED EMBODIMENTS

Hereinafter, the preferred embodiment of the present invention will be described with reference to the appended drawings.

First, referring to FIG. 1, an electrophotographic copying machine, that is, an example of an image forming apparatus in which a toner supply container in accordance with the present invention is mounted, will be described regarding its structure.

Electrophotographic Image Forming Apparatus

Figure 1:
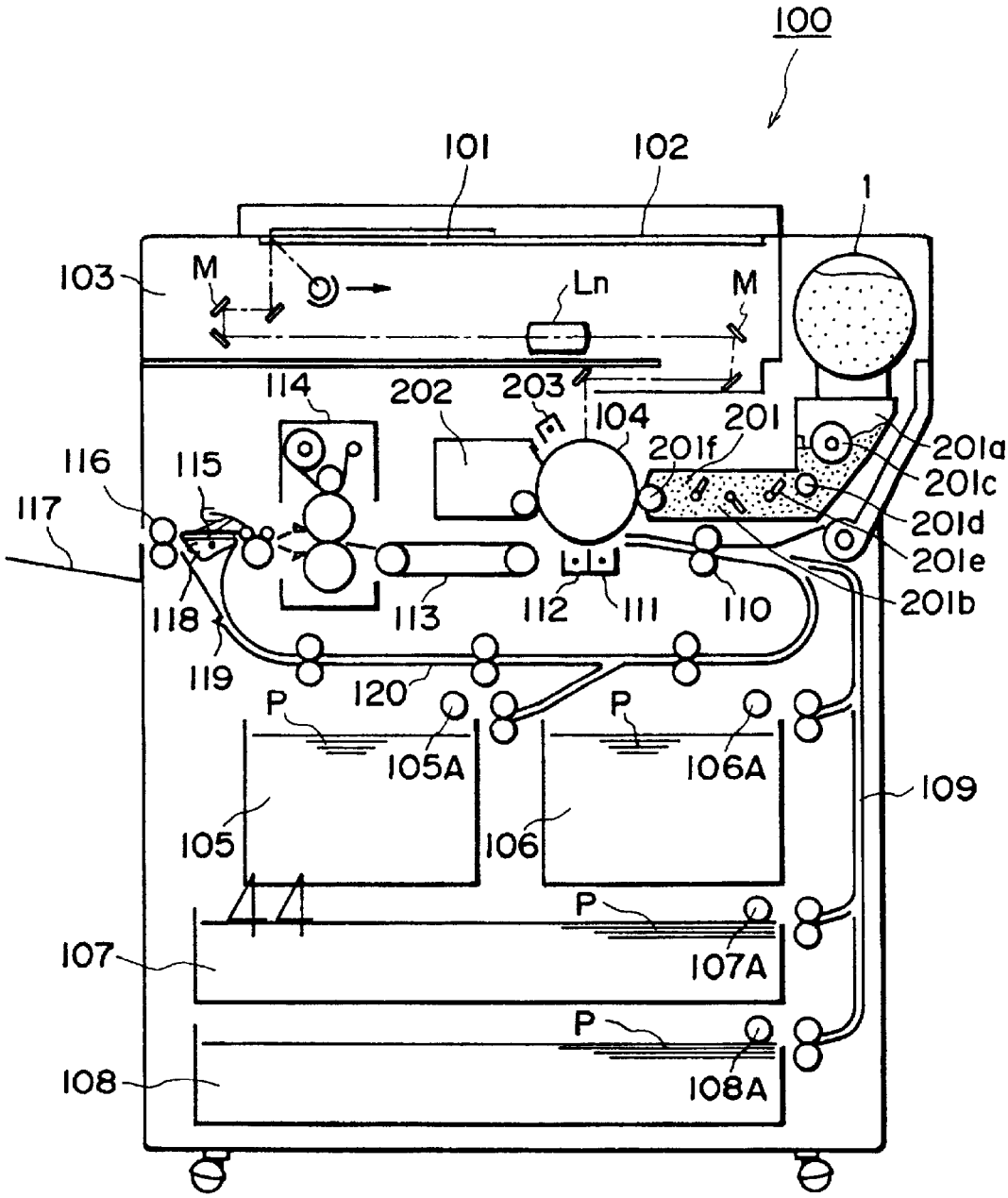
FIG. 1 is a schematic sectional view of the main assembly of the forming apparatus (electrophotographic image copying machine) in an embodiment of the present invention.

In FIG. 1, a referential code 1 designates the main assembly of an electrophotographic copying machine (which hereinafter will be referred to as apparatus main assembly).

Designated by a referential code 100 is an original, which is placed on an original placement glass platen 102. An optical image in accordance with the image formation data of the original 101 is focused on an electrophotographic photoconductive member as an image bearing member (which hereinafter will be referred to as photoconductive drum) by the plurality of mirrors and lenses Ln of an optical portion 103.

Designated by referential codes 105–108 are cassettes. Among the recording mediums p (which hereinafter will be referred to as "paper p") placed in layers in these cassettes, the paper, the size of which matches the information inputted by an operator through a control panel 100*a* shown in FIG. 2, or the size of the original 100, is selected based on the paper size information of the cassettes 105–108. Incidentally, the choice of the recording medium is not limited to paper. For example, OHP or the like may be used as recording medium, as necessary.

The selected paper p is fed out of one of the cassettes 105–108 by the corresponding feeding/separating apparatus among feeding/separating apparatuses 105A–108A, and is conveyed further to a registration roller 110 by way of a conveying portion 109. The registration roller 110 allows the paper p to be further conveyed in synchronism with the rotation of the photoconductive drum 104 and the scanning timing of the optical portion 103. Designated by referential codes 111 and 112 are transfer charging device and separation charging device, respectively. The toner image formed on the photoconductive drum 104 is transferred onto the paper p by the transfer discharging device 111.

Then, the paper pi onto which the toner image has been transferred, is separated from the photoconductive drum 104 by the separation discharging device.

Thereafter, the paper p is conveyed by a paper conveying portion 113 to a fixing portion 114 bi in which the toner image on the paper p is fixed to the paper p by heat and pressure. Then, when the copying machine is in the single-sided copy 1 2 mode, the paper p is conveyed through an inverting portion 115, and is discharged into a delivery tray 117 by a discharge roller 116, whereas when in the two-sided copy mode, the paper p is conveyed to the registration roller 110 by controlling the flapper 118 of the inverting portion 115, through re-feeding conveying paths 119 and 120, and is discharged into the delivery tray 117 after being passed through the same path as the one through which the paper p is passed when in the single-sided copy mode.

More specifically, when in the two-sided mode, the paper p is only partially discharged from the apparatus main assembly by the discharge roller 116, while being passed through the reverting portion 115. In other words, as soon as the trailing end of the paper p passes the flapper 118 while the paper p is still being discharged from the apparatus main assembly, the flapper 118 is controlled and at the same time, the discharge roller 116 is reversely rotated to feed the paper p back into the apparatus main assembly. Thereafter, the paper p is conveyed to the registration roller 110 by way of re-feeding conveying paths 119 and 120. Then, the paper p is discharged into the delivery tray 117 following the same path as the one through which the paper p is passed when in the single-sided copy mode.

In the apparatus main assembly 100 structured as described above, a developing portion 201, cleaning portion 202, a primary charging portion 203, and the like, are disposed around the photoconductive drum 104. The developing portion 201 develops, with the use of toner, an electrostatic latent image formed by exposing the peripheral surface of the photoconductive drum 104 by the optical portion 103. A toner supply container 1 for supplying toner to the developing portion 210 is removably mounted in the toner supply container mounting portion of the apparatus main assembly.

The developing portion 210 is provided with a toner hopper 201*a* and a developing device 201*b*. The toner hopper 201*a* has a stirring member 201*c* for stirring the toner supplied from the toner supply container.

After being stirred by the stirring member 201*c*-, the toner is sent to the developing device 201*b* by a magnetic roller 201*d*. The developing device 201*b* has a development roller 201*f* and a toner sending member 201*e*. The toner is sent from the toner hopper 201*a* to the toner sending member 201*e* by the magnetic roller 201*d*, and is sent further to the development roller 201*f* by the toner sending member 201*e*. Then, the toner is supplied to the photoconductive drum 104 by the development roller 201*f*.

Figure 2:
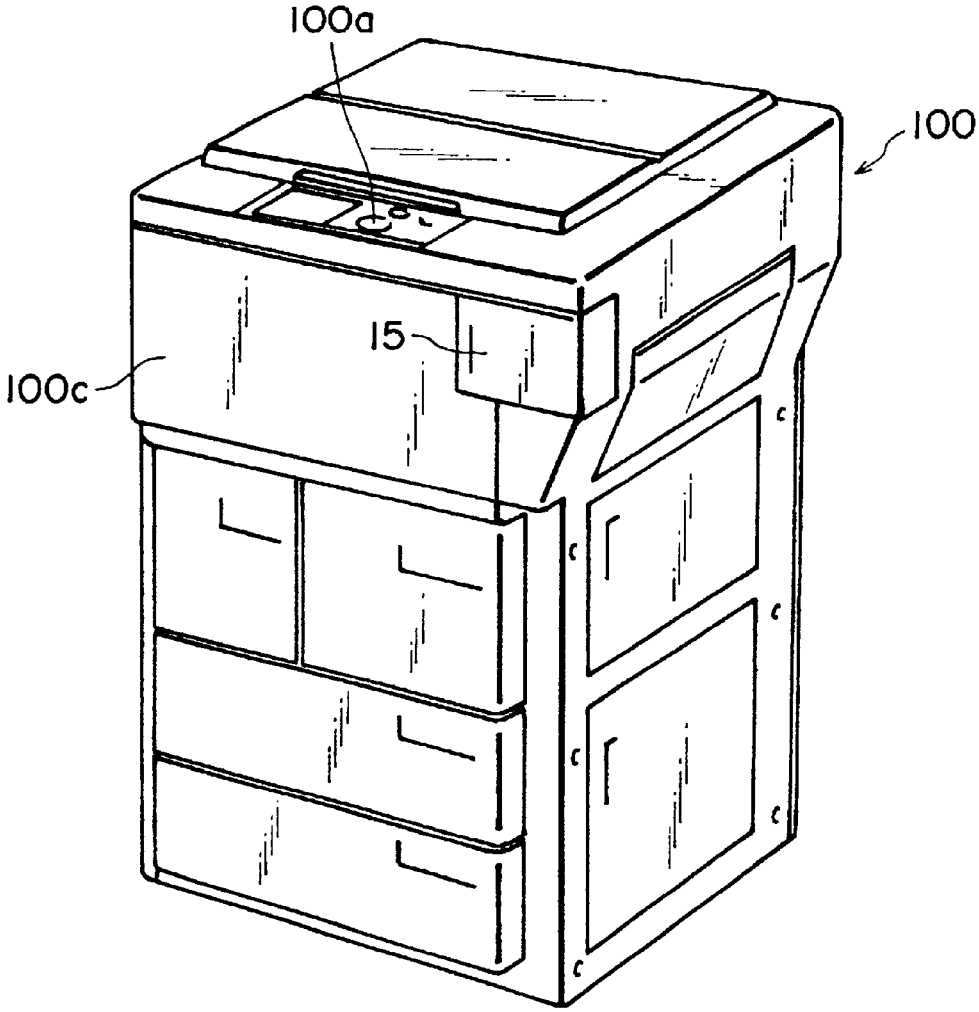
FIG. 2 is a perspective view of the electrophotographic copying machine shown in FIG. 1.
Figure 3:
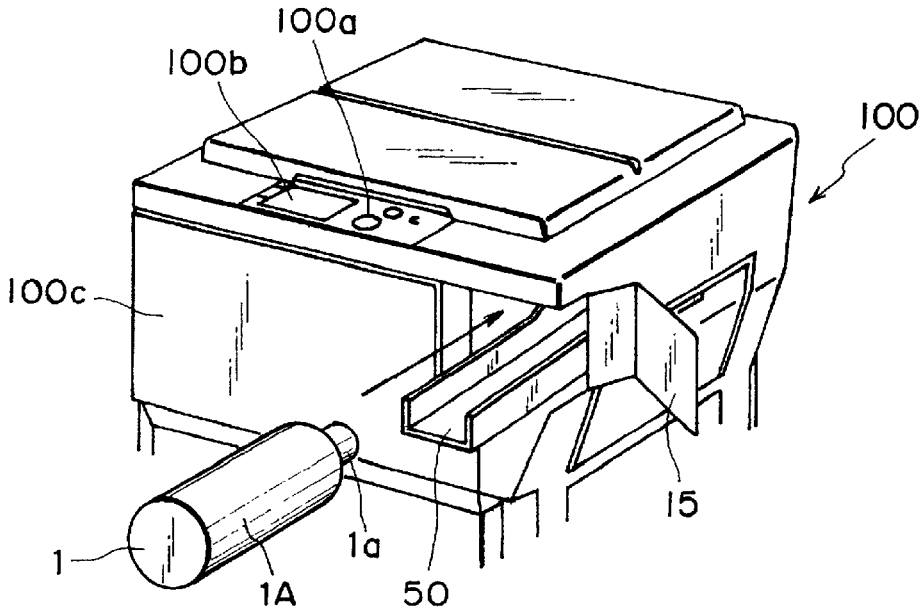
FIG. 3 is a perspective view of the top portion of the electrophotographic copying machine shown in FIG. 1, for showing how a toner supply container is mounted into the electrophotographic copying machine by opening the toner supply container exchange cover.

The cleaning portion 202 is for removing the toner particles remaining on the photoconductive drum 104. The primary charging device 203 is for charging the photoconductive drum 104. Designated by a referential code 15 in FIG. 2 is a toner supply container replacement cover, which constitutes a part of the exterior of the apparatus main assembly 100. As a user opens the toner supply container replacement cover 15, a toner supply container bed 50 is pulled out to a predetermined position by a driving system (unshown). The toner supply container 1 is placed on this container bed 50. When a user takes the toner supply container 1 out of the apparatus main assembly, the user removes the toner supply container 1 on the container bed 50 after the container bed 50 is pulled out of the apparatus main assembly. The toner supply container replacement cover 15 is a dedicated cover for the placement or removal (replacement) of the toner supply container; in other words, it is opened or closed only for placing or removing the toner supply container 1. As for the maintenance of the apparatus main assembly, it is carried out by opening a front cover 100.

The toner supply container 1 may be directly placed in the apparatus main assembly or removed therefrom, without providing the apparatus main assembly with the container bed 50.

Embodiment 1

Figure 4:
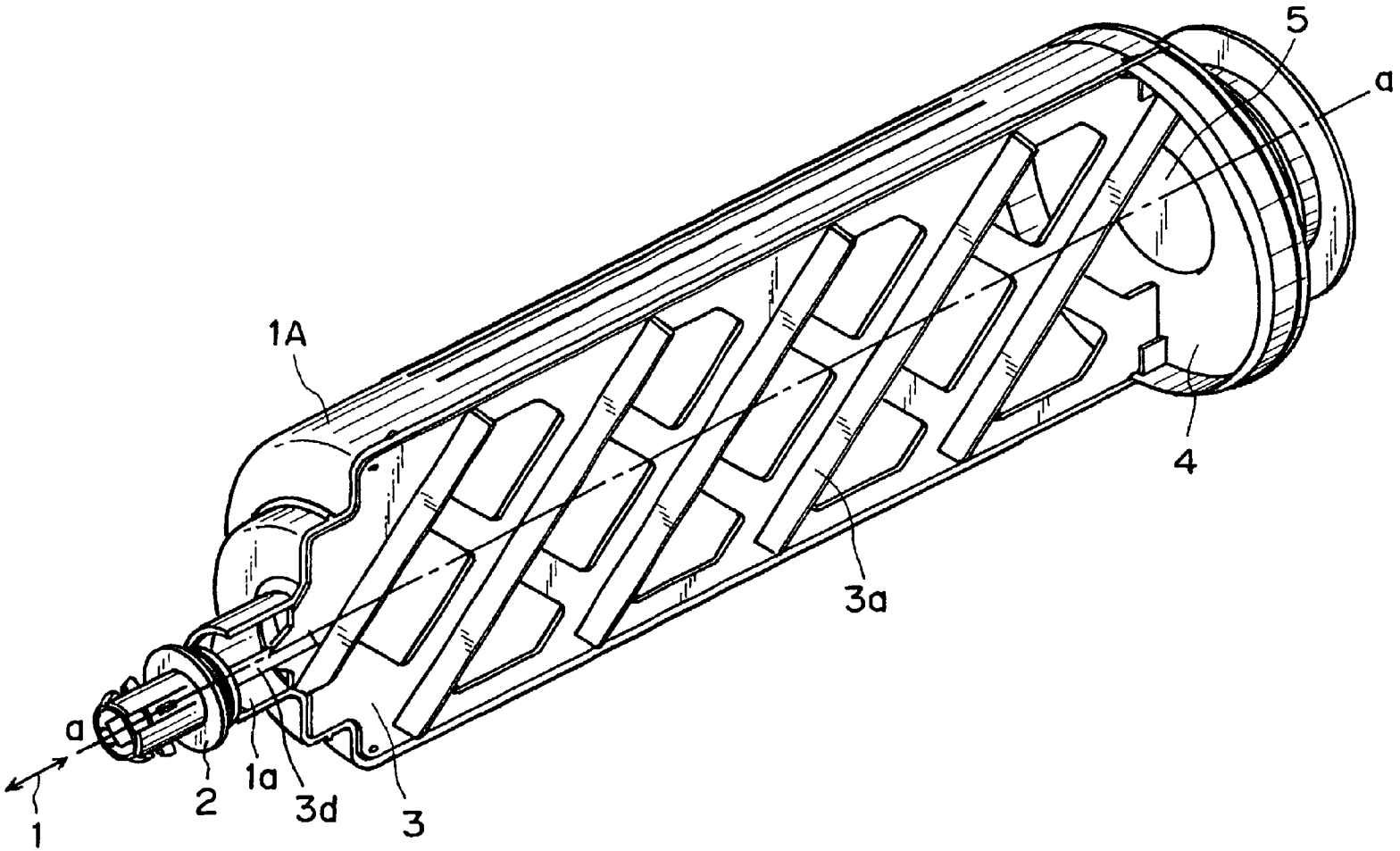
FIG. 4 is a perspective view of the toner supply container in the first embodiment of the present invention, in which a half of the cylindrical wall has been left out in order to show the interior of the container.
Figure 5A:
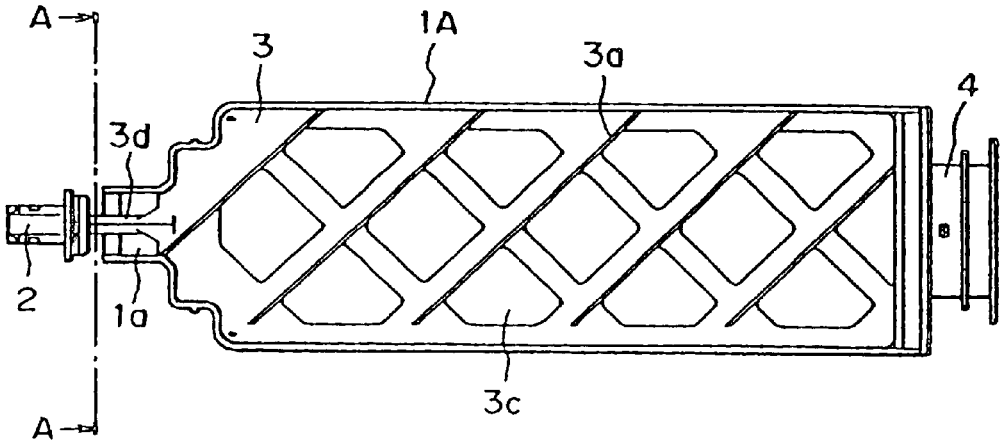
FIG. 5(A) is a sectional view of the toner supply container in the first embodiment of the present invention, at the plane inclusive of the axial line of the container, as seen from the front side of the copying machine.
Figure 5B:
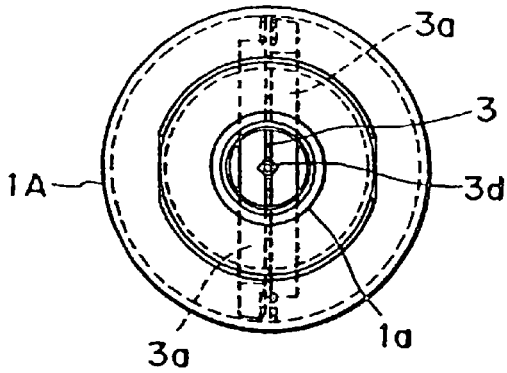
FIG. 5(B) is a sectional view of the same container, at a plane A—A in FIG. 5(A).

Next, referring to FIGS. 4 and 5, the toner supply container in the first embodiment of the present invention will be described. FIG. 4 is a partially broken perspective view of the toner supply container in the first embodiment of the present invention. FIG. 5(A) is a sectional view of the toner supply container, as seen from the front side of the copying machine, and FIG. 5(B) is a plan view of the toner supply container, as seen from the plane A—A in FIG. 5(A).

Toner Supply Container

The toner supply container 1 is structured so that it is mounted into the image forming apparatus main assembly by a user, in the direction virtually parallel to the lengthwise direction of the main body of the container, from the sealing member 2 side of the container. When removing the toner supply container 1, the toner supply container 1 is pulled out of the apparatus main assembly in the direction reverse to the direction in which it was mounted.

As shown in FIGS. 4 and 5, the toner bottle 1A (bottle or main body of the container) is generally hollow-cylindrical, and a cylindrical portion is formed projected from one end surface at its central position. The free end side of the cylindrical portion defines an opening 1*a* for discharging the toner into the image forming apparatus (developing device) side.

Into the opening 1*a*, a sealing member 2 for sealing the opening 1*a* is press-fitted, and the sealing member 2 is slid in an axial direction of the toner bottle 1A relative to the main body of the toner bottle 1A to automatically open and close the opening 1*a*.

In FIG. 4, it is shown as being in the open position.

The description will be made as to the internal structure of the toner bottle 1A.

The toner bottle 1A is generally cylindrical and is placed substantially horizontally in the main assembly of image forming apparatus. The bottle 1A is rotated by a rotational driving force from the main assembly 100 of the image forming apparatus through an engaging projection provided in the sealing member 2 and a feeding member 3 which will be described hereinafter.

A feeding member 3 generally in the form of a flat plate is provided in the toner bottle 1A and divides the inside of the toner bottle 1A into two parts, and it extends in the longitudinal direction of the bottle 1A over its full length.

Figure 7A:
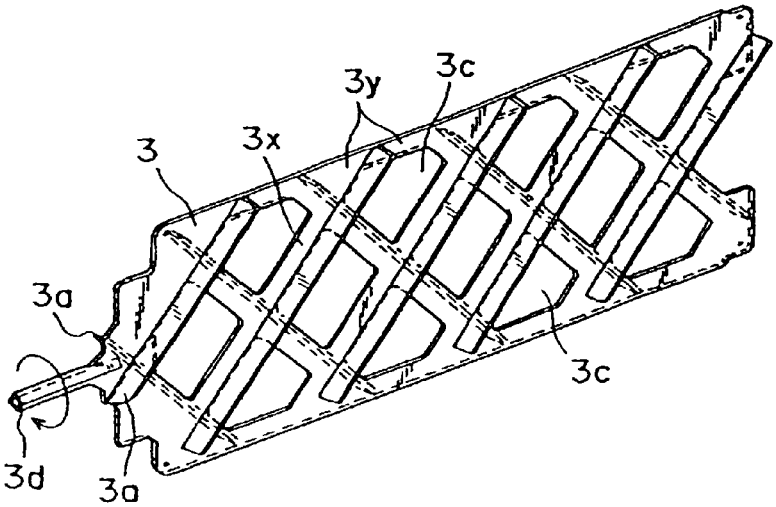
Figure 7B:
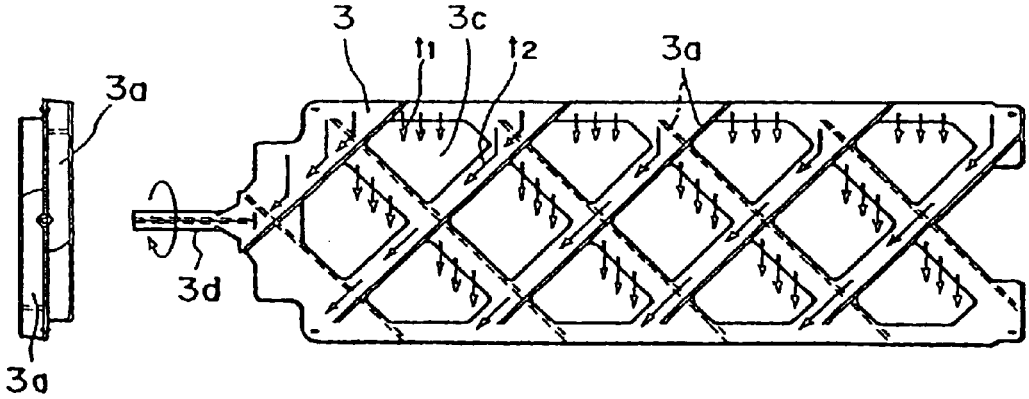

On each of the sides of the flat part of the feeding member 3, there are provided a plurality of projections 3*a* (guiding portion) which is extended inclined with respect to the rotation axis a—a of the bottle 1A toward the opening (when the feeding member takes a position effective to guide the toner downwardly toward the opening, that is, when the feeding member 3 takes the position shown in (B) of FIG. 7). The flat plate-like region has a function of supporting the inclined projections. One end of the inclined projection 3*a* closest to the opening 1*a* continues to the cylindrical portion defining the opening 1*a*. Finally, the toner slides down on a surface of the closest projection 3*a* with the rotation of the feeding member 3 to the cylindrical portion and then is discharged through the opening 1*a*. The one end of the projection 3*a* closest to the opening 1*a* may be extended to a neighborhood of the cylindrical portion.

As shown in FIG. 5, (B), the projections 3*a* are provided on both of the sides of the flat plate portions of the feeding member 3 in a rotational symmetry arrangement such that toner is fed toward the opening 1*a* with a unidirectional rotation of the toner bottle. With each of 180° rotations of the feeding member together with the model, the toner lifted by the projections slides down on the surface of the projections, by which the toner is gradually fed toward the opening and to the opening.

Thus, when the feeding member rotates integrally with a bottle, two toner feeding operations and discharging operations are intermittently carried out. By a continuous high-speed rotation, the toner feeding and the discharging operations are carried out substantially continuously. Here, the rotation symmetry means such a substantially symmetry with respect to the rotation axis that projections 3*a* on the respective sides of the feeding member 3 take substantially the same positions with each 180° rotations.

Figure 6A:
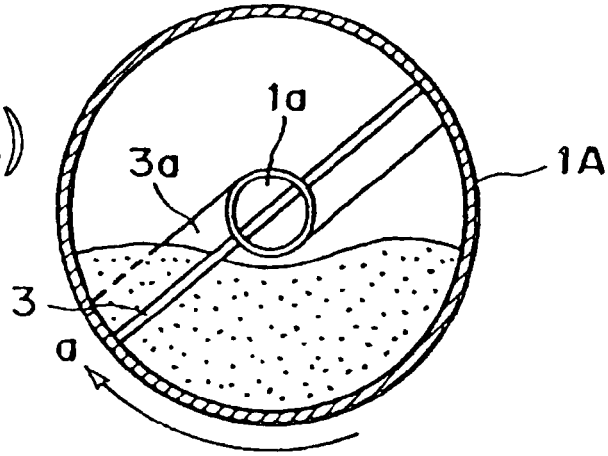
FIGS. 6(A), 6(B) and 6(C) are schematic sectional views of the toner supply container in the first embodiment of the present invention, which show how the toner in the container is discharged from the container.
Figure 6B:
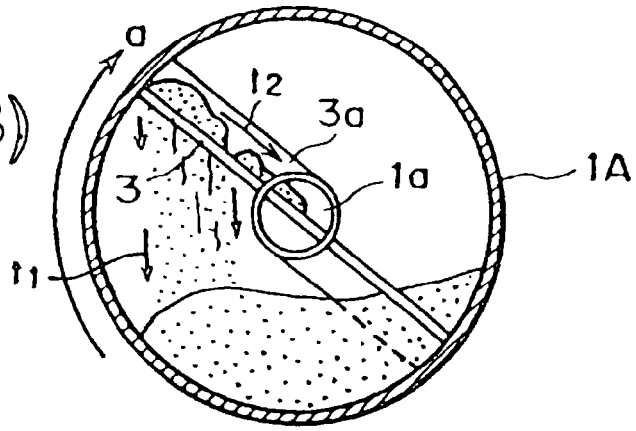
Figure 6C:
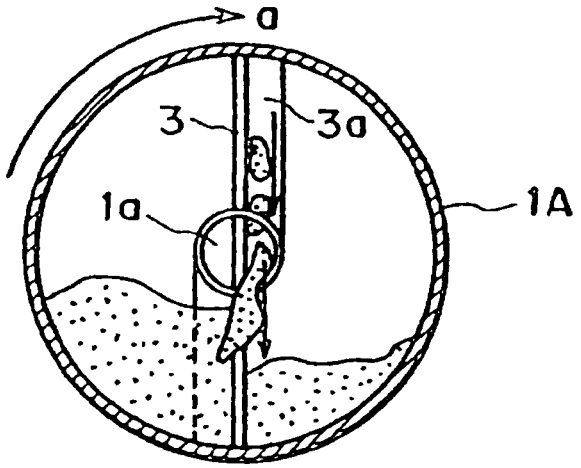

Referring to FIGS. 6, 7, the toner discharging principle of the toner supply container 1 of this embodiment will be described. FIG. 6 is a partially sectional view taken along a line A—A of FIG. 5.

The toner bottle 1A rotates integrally with the feeding member in the direction indicated by an arrow a. In the toner bottle 1A, the toner particle exist in the bottom portion is indicated by dots. The plate-like portion of the feeding member 3 is provided with holes or openings which will be described hereinafter. The feeding member has a toner scooping or lifting portions constituting by the plate-like portion without the holes and the outside portions of the projections, as indicated by 3*y* in FIG. 7, (A). In the state shown in (A) of FIG. 6, the lift portion is within the toner powder at the bottom of the bottle. With the rotation of the bottle integrally with the feeding member 3, the lift portion immersed in the toner powder gradually lifts the toner against the gravity.

More particularly, in this embodiment, the toner is lifted or raised in a space defined by the lift portion (3*y* region in (A) of FIG. 7) and the inner surface, contacted thereto, of the bottle. The lift portion is defined by such a portion of the inclined projection as takes the upper position when the feeding member takes a position for guiding the toner downwardly toward the opening (FIG. 7, (B) for example).

The plate-like portion is disposed substantially in contact with the inner surface of the bottle over the entire length of the bottle, the toner can be efficiently lifted using the inner surface of the bottle.

The toner not lifted by the lift portion passes through the hole portion 3*c*, and therefore, the toner is stirred in parallel with the lifting action.

With rotation of the bottle, a part of the toner scooped or lifted by the feeding member 3, as shown in (B) of FIG. 6, is guided downwardly toward the opening by the gravity with the aid of the inclined projections 3*a* and a portion 3*x* of the plate-like portion supporting them ((B) of FIG. 6 and t2 in (B) of FIG. 7).

A part of the toner lifted by the lift portion of the feeding member 3 is not fed or guided toward the opening, but drops through the hole portion 3*c* by the gravity ((B) of FIG. 6, and t1 in (B) of FIG. 7). Again, the toner can be stirred by the dropping through the hole portion 3*c* together with the guiding and feeding of the lifted toner.

By repeating the above-described actions, the toner in the toner bottle 1A is gradually fed toward the discharge opening, while being stirred. Finally, the toner is discharged through the opening 1*a* from the portion above the inclined projection 3*a* continuing to the opening 1*a*, as shown in (C) of FIG. 6.

Since the plate-like portion extends substantially over the entirety of the length of the toner bottle 1A, and the plurality of inclined projections 3*a* are provided in the manner described above, the toner is efficiently fed while being sufficiently stirred.

The inclined projections are partly overlapped as seen in the direction perpendicular to the rotation axis, that is, when they are projected onto the rotation axis. By doing so, the toner advanced toward the opening by an inclined projection is then further advanced by an inclined projection disposed immediately in front of the inclined projection. Thus, the toner is efficiently stirred and fed.

Using this embodiment, by properly selecting the configurations, dimensions, arrangement and structures of the inclined projection 3*a* provided on the feeding member 3, various toner discharging property can be provided.

Feeding Member

The feeding member 3 will be described in detail. The feeding member 3 is extended substantially the entire length of the main body 1A of the container and partition the inside space of the main body 1A. In this embodiment, the feeding member 3 divides the main body 1A of the container into two parts, but it may divide the space into three or four parts.

The feeding member 3 preferably extends across the opening 1*a* or an extension of the opening 1*a* in the direction of the axis. The reason is as follows. The toner is finally discharged through the opening 1*a* by the toner feeding function of the inclined projection 3*a* as described hereinbefore. Therefore, the feeding member 3 preferably extends across the opening 1*a* adjacent to the flange portion (end wall surface) 3*b* of the main body.

The feeding member 3 rotates integrally with the main body 1A of the container, and extends over the entire length of the main body 1A of the container. Thus, it functions as if it is reinforcing ribs for the main body 1A.

Since the feeding member 3 rotates integrally with the main body 1A of the container, it can be avoided that toner is rubbed between the feeding member 3 and main body 1A with the result of solidification.

The toner supply container may have an elongated configuration, since the strength can be assure by the reinforcing function of the feeding member 3 (like a framework maintaining the shape of the hollow body). For the same reason, the thickness of the wall of the main body 1A may be reduced, which leads to cost reduction of the main body 1A and greater choice of materials of the main body 1A.

Referring to FIG. 7, the toner stirring effect will be described.

FIG. 7 shows a perspective view of a feeding member 3 according to an embodiment of the present invention (A), and a front view thereof and a left-hand side view thereof (B).

The feeding member 3 is provided with a plurality of through-hole portions 3*c* in the flat plate portion. By the hole portions 3*c*, the toner in the toner bottle 1A are substantially freely movable between the spaces defined by the feeding member 3.

Therefore, a certain amount of the toner lifted by the rotation of the toner bottle is guided and fed by the inclined projection 3*a* toward the opening, and the other amount of the lifted toner drops through the hole portions 3*c*. Thus, there occurs various motions of the toner within the bottle.

The dropping of the toner through the hole portions 3*c* is effective to loosen the coagulated toner by the impact resulting from the dropping, thus improving the flowability of the toner in the bottle. The hole portions 3*c* are provided substantially over the entire length of the toner bottle, and therefore, the flowability of the toner is enhanced at any part of the inside of the bottle very quickly, so that satisfactorily discharging performance can be provided at the initial stage after the exchange of the toner containers. For this reason, the preliminary rotation for the standardization of the discharging performance is not necessary, thus minimizing the down time (the time period in which the image formation is impossible) of the image forming apparatus.

In the case of the conventional toner supply container in which a helical projection is formed on the inside surface of the bottle, there is no positive means to loosen the coagulated toner, and therefore, it has been necessary to rotate until the toner is predicted to have been loosened to such an extent that toner is dischargeable.

According to this embodiment, however, on the feeding member 3 positively moves the toner and enhances the flowability. The toner can be discharged without problem even if the toner is bridged and therefore caked.

The feeding member 3 is preferably manufactured through an injection molding of a plastic resin material, but may be manufactured through another method and/or from a different material.

The material thereof is preferably the same as the main body 1A of the container from the standpoint of recycling the container. More particularly, ABS, PP, POM, HI-PS are preferable materials. In this embodiment, HHI-PS was used.

Inclined Projection

Figure 8A:
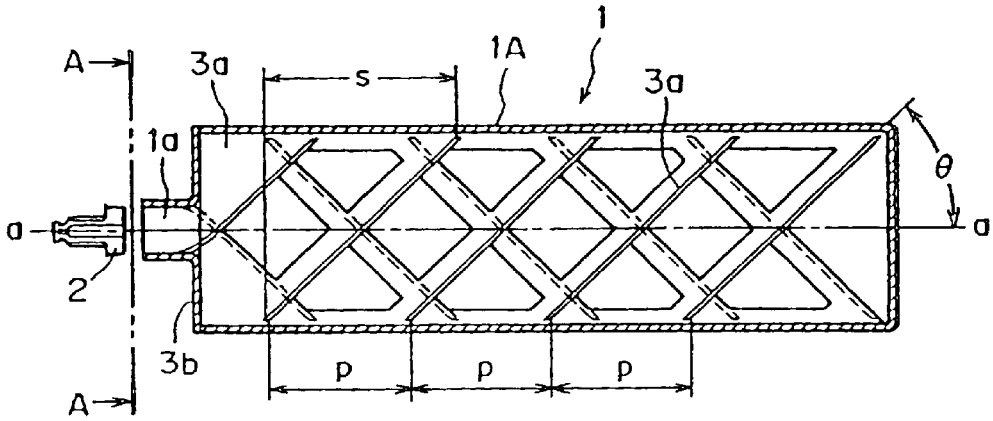
FIGS. 8(A) and 8(B) are sectional view, as seen from the front side of the copying machine, and plan view, as seen from the plane A—A in FIG. 8(A), of the toner supply container in the first embodiment of the present invention, for describing the various structural components of the container.
Figure 8B:
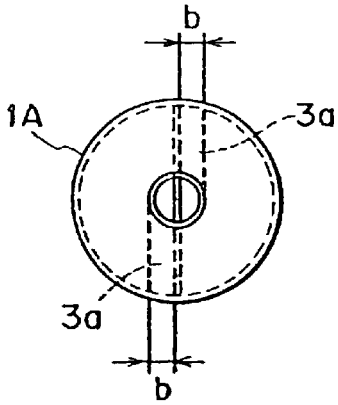

Referring to FIG. 8, the description will be made as to the inclined projection 3*a* which is significantly influential to the stirring and feeding performance of the toner. In FIG. 8, θ is an inclination angle of the inclined projection 3*a* relative to the bottle rotation axis a—a, and dimension p is an interval between adjacent inclined projections 3*a*. In addition, s is a distance through which the toner is fed by the inclined projection 3*a*, b is a width of the inclined projection 3*a*.

The inclined projection 3*a* is in the form of a projection from the flat plate portion of the feeding member 3, and therefore, the inclined projection 3*a* has a function as if it cuts into the toner powder in the toner bottle when the toner bottle 1A is rotated. In addition, the toner is fed toward the opening by the inclination of the inclined projection 3*a*, thus performing the dual functions.

By changing the inclination angle θ of the inclined projections 3*a*, the toner feeding power is selectively determined. For example, when the inclination angle θ is changed to provide a steep inclination, the toner slides on the inclined projection 3*a* in a fashion close to the vertical dropping. In this case, the toner sliding action is enhanced so that toner feeding amount is larger, but the toner feeding distance s per inclined projection is short, and therefore, the feeding speed is lower. When the inclination angle θ is changed to provide less steep arrangement, the toner feeding distance s per inclined projection 3*a* is long, so that feeding speed is higher. However, if inclination angle θ is too small, the toner does not easily slides down on the inclined projection 3*a*. An optimum design of the toner feeding power is accomplished by properly selecting the inclination angle θ. The inclination angle θ was preferably 30°–80° and further preferably 45°–70°, from experiments.

In the foregoing analysis, the toner feeding distance s by the inclined projection is assumed as a length thereof projected on the rotation axis. The lower side of the inclined projection (when the feeding member guides the toner downwardly toward the opening ((B) of FIG. 7, for example)) is away from the inside the surface of the bottle. The structure is advantageous.

By doing so, it can be avoided the toner lifted by the inclined projection overtakes the immediately front side inclined projection due to the inertia of the toner sliding down on the inclined projection. Thus, the toner feeding distance per inclined projection can be increased.

On the other hand, as shown in (B) of FIG. 7, it is preferable that upper side of the inclined projection ((B) of FIG. 7, for example) is as close as possible to the inner surface of the bottle, and further preferably it is contacted into the inner surface of the bottle.

By doing so, substantially all of the toner lifted by the lifting portion can be guided and fed on the inclined projection.

Thus, the toner can be efficiently fed.

Inclination Angle and Intervals of the Projections

Figure 9A:
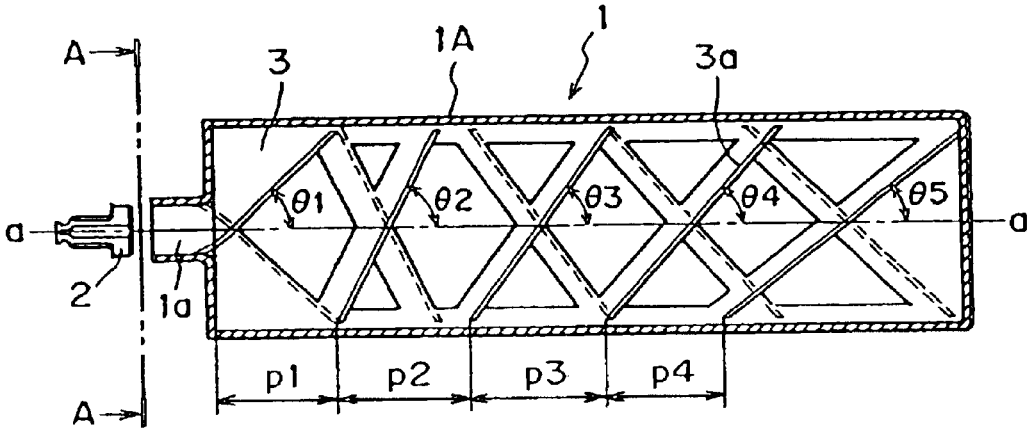
FIGS. 9(A) and 9(B) are sectional view, as seen from the front side of the copying machine, and plan view, as seen from the plane A—A in FIG. 9(A), of a toner supply container slightly different in internal structural component from the toner supply container in the first embodiment of the present invention.
Figure 9B:
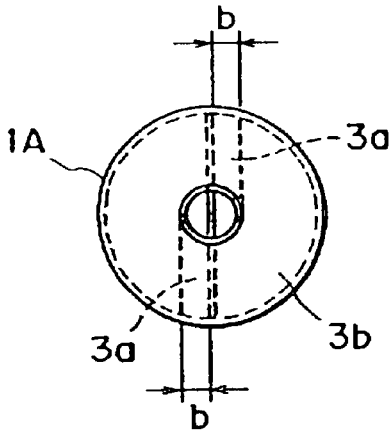

It is not necessary that all of the inclined projections 3*a* are inclined to the same inclination angle θ. As shown in FIG. 9, (A), the inclined projections 3*a* may be set differently for the inclined projections 3*a* (inclination angle θ1, θ2, θs 3). Similarly, the intervals p are not necessary regular, but may be set for the inclined projections 3*a* (intervals p1, p2, p3).

By the settings, the toner discharging property can be controlled.

In a conventional toner supply container which is rotated as a whole, the toner discharge amount changes in accordance with the amount of the toner remaining in the toner bottle, and therefore, it is very difficult to maintain a constant discharge amount. This is because at the initial stage in which the toner is filled in the bottle and therefore the powder pressure of the toner is high, the toner discharging amount is necessarily large, and at the last stage with the small amount of the toner contained in the bottle, the toner discharging amount is extremely small as compared with the discharge amount at the initial stage.

However, according to the structure of this embodiment, by properly setting the inclination angle Gs and the intervals p thereof, the toner discharging amount can be made constant.

For example, the interval p is set at a large distance adjacent the opening 1*a* so as to provide a relatively low toner discharging speed, and inclination angle θ is set at a small angle so as to provide a higher toner discharging speed in the portions away from the opening 1*a*. In this manner, for example, the feeding power can be changed in the longitudinal direction of the toner bottle. By doing so, at the initial stage, the tendency of large toner discharging amount can be suppressed, and on the contrary at the last stage, the toner feeding speed is higher. Thus, substantially constant toner discharge amount can be assured.

Width

As shown in FIG. 9, (B), the width of the inclined projection 3*a* is selectable to adjust the toner feeding force, similarly to the inclination angles θ and the intervals p.

For example, the larger the width b, the larger the amount of lifted toner. However, if it is too large, the filling of the toner at the time of manufacturing of the toner supply container is influenced. Therefore, it is set to be a preferable dimension.

The experiments and investigations by the inventors have revealed that the width of the inclined projection 3*a* is preferably approx. 5–20% the inner diameter d of the toner bottle. Further preferably, it is 10–15%.

The width b finally continues to the opening la of the discharge opening and may be larger than the width of the opening 1*a*.

If it is smaller than the width of the opening 1*a*, the toner feeding efficiency may be lower. A sufficiently practical feeding performance can be provided if it is not less than one half the opening 1*a*.

In this embodiment, it is substantially the same as the width of the opening 1*a*.

Assembling Method of the Toner Supply Container

An assembling method of the toner supply container 1 according to an embodiment of the present invention will be described.

Figure 10:
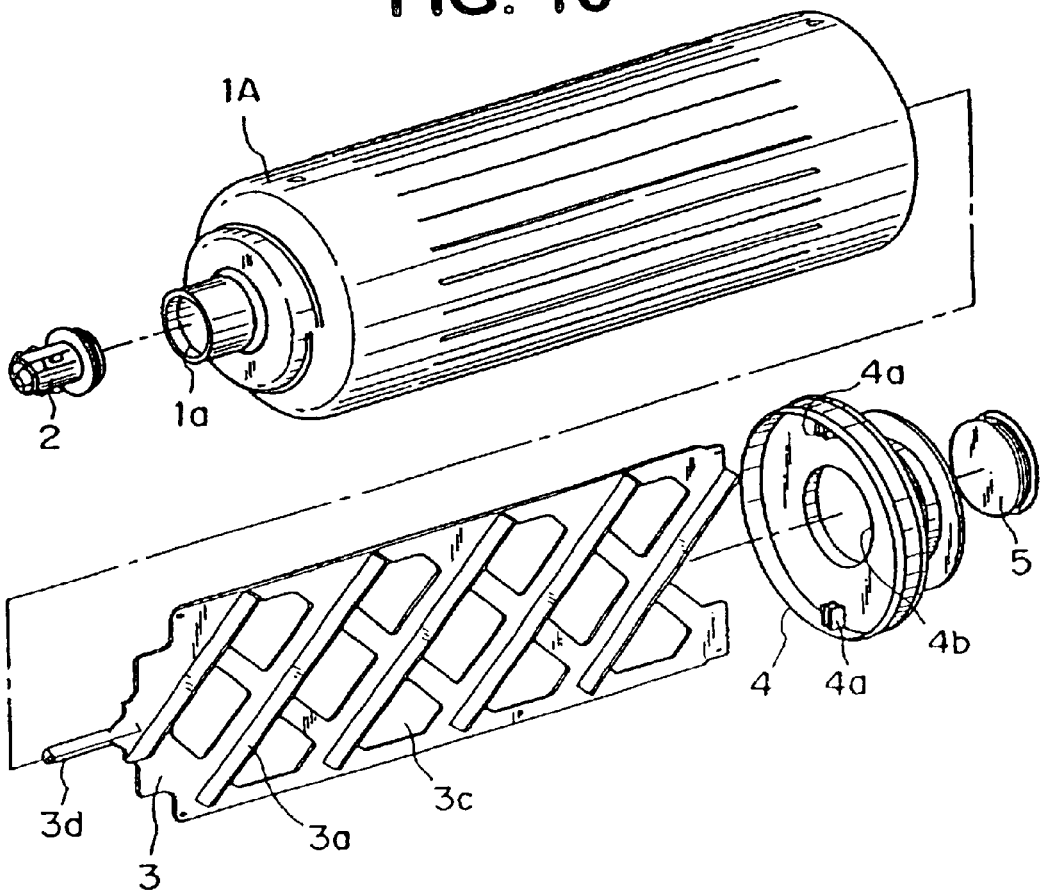
FIG. 10 is an exploded perspective view of the toner supply container in the first embodiment of the present invention, for showing the assembly process thereof.

FIG. 10 is a perspective view illustrating the assembling of the toner supply container 1 according to Embodiment 1. The structure of the toner supply container 1 according to this embodiment is very simple, and can be assembled by coupling five parts, as shown in FIG. 10. The main body 1A of the container can be easily produced by injection molding or blow molding, and the sealing member 2, the feeding member 3, the flange member 4, the filling port and the capping member 5 can be easily produced by injection molding. In this embodiment, all the parts are manufactured through injection molding.

As for the method for coupling the main body 1A of the container and the flange member 4, an ultrasonic welding or vibration welding method is usable, or they may be bonded by hot melt adhesive material or another adhesive material, by which the sealing property is assured.

Or, a lightly press-fitted engagement between the outer periphery portion of the flange portion and the cylindrical end is usable. In this case, the outer periphery of the engaging portion is wound with an adhesive tape or the like. Then, the toner bottle is easily disassembled, and therefore, the recycling of the toner supply container is easy.

The steps of assembling is as follows. First, the feeding member 3 is inserted to the flange 4 such that end of the feeding member 3 is sandwiched between the projections 4*a* provided on the inner surface of the flange 4. Then, the flange member 4 is coupled with the main body 1A flange member 4 of the container, and the sealing member 2 is engaged with the drive transmitting shaft portion 3*d* of the feeding member 3.

Thereafter, the toner is filled into the main body through the toner filling opening 4*b*, and a filling cap 5 is press-fitted into the filling port 4*b*, by which the assembling of the toner supply container is accomplished.

Figure 11A:
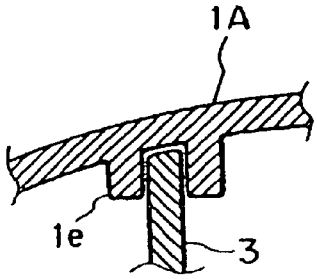
FIGS. 11(*a*) and 11(*b*) are schematic sectional views of the portion of a toner supply container in accordance the present invention, where its partition wall meets the internal wall of its cylindrical wall, and show the positional relationship between the partition wall and internal wall of the cylindrical wall.
Figure 11B:
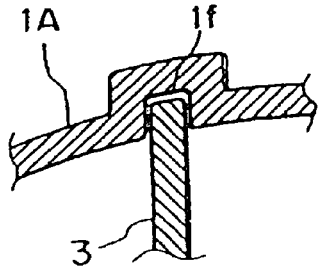

Using such an assembling method, attention is to be paid to the portion where the feeding member 3 is contacted to the inner surface of the main body 1A of the container. As described hereinbefore, if there is a gap between the feeding member 3 and the inner surface of the main body, the toner passes through the gap with the result of reduction of the feeding efficiency, and the amount of the remaining toner which cannot be discharged at the last stage, increases. This is not preferable. FIG. 11 shows examples of the structures which prevents the reduction of the toner feeding efficiency or the increase of the amount of remaining toner.

In example (a) of FIG. 11, the main body of the container has two parallel projection 1*e* in the form of ribs extending in parallel to the direction of the axis, and the feeding member 3 is inserted into the gap provided between the projections 1*e*. This structure is suitable for the manufacturing of the main body 1A through the injection molding. The free end surface of the feeding member 3 is not contacted to the main body 1A of the container, but the toner does not pass through, and therefore, no decrease of feeding efficiency or the increase of remaining toner can be effectively prevented. The projections 1*e* in the form of the ribs may be provided only at a downstream side of the feeding member 3 with respect to the rotational direction of the container.

FIG. 11, (b) shows another example, wherein a recess 1*f* is provided extended in the axial direction, and the feeding member 3 is placed in the recess 1*f*. This example is suitable for the main body 1A manufactured through the blow molding. The toner feeding efficiency and the remaining toner are the same as with example (a).

Figure 12:
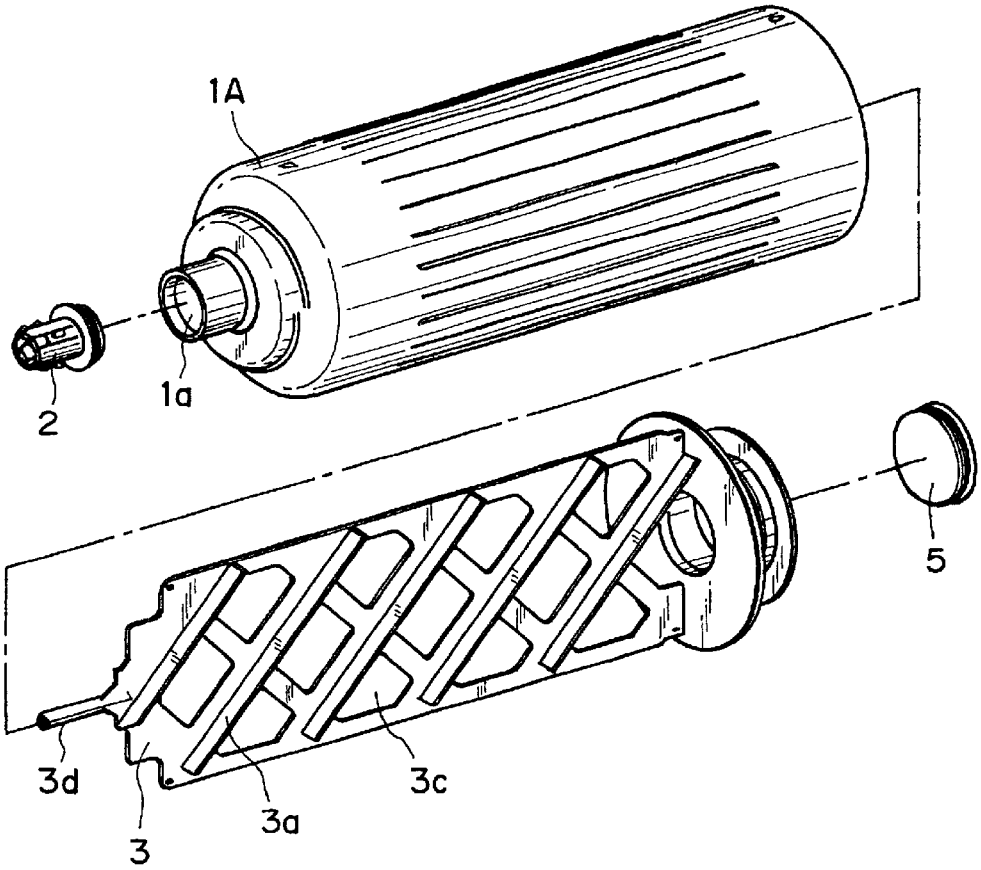
FIG. 12 is an exploded perspective view of the toner supply container in another embodiment of the present invention, for showing the assembly process thereof.

FIG. 12 illustrates another embodiment of assembling step. In this example, the feeding member 3 and the flange member 4 are integrally injection-molded, and then the integral member is inserted into the main body 1A. By doing so, the number of parts can be reduced to four.

Thus, according to the embodiments of the present invention, various manufacturing method and assembling method are usable. In addition, since the stirring member is not rotated in the toner container unlike a type of a conventional toner supply container, there is no problem of increase of the required torque for stirring.

Bearing members or the like are not used for receiving t stirring shaft, the part cost is reduced and the coagulation of the toner particles due to the sliding actions at the bearing portions, can be avoided.

Recycling of Toner Supply Container

Recycling of the used toner supply container 1 will be described. For the purpose of easy disassembling, the main body 1A and the flange member 4 are united by an adhesive tape. The disassembling operation is opposite from the assembling operation. More particularly, the sealing member 2 is first removed, and the adhesive tape is removed, and the main body 1A is separated into four parts as shown in FIG. 12. The main body 1A, the feeding member 3 with the projections 3*a*, the flange member 4, the sealing member 2 and the filling cap 5 are cleaned using air blow. Subsequently, they are reassembled into a container, and the predetermined amount of the toner is filled, by which the recycling is completed.

There is no part that is worn, and the reuse ratio is high. In normal cases, there is no part to be replaced. The structures are suitable for air cleaning, because there is no complicated structure part or no part involving a portion to which the air does not easy reach. Therefore, the cleaning can be simply and assuredly carried out. The toner supply property is the same as with the new toner bottle.

On the other hand, it is possible that used toner supply container 1 may be crushed, and the materials are reduced. Even if the main body 1A, the feeding member 3, the flange member 4, the sealing member 2 and the filling cap 5 are made of different materials, they are very easily separated into the respective parts. This is convenient for such a case of recycling. In addition, the toner supply container 1 of the embodiments of the present invention gives great choice of material of the feeding member 3. It is possible to make all the parts from the same material. In that case, the main body 1A of the container is constructed by ultrasonic welding, so that when the main body of the container is reused, it is crushed without disassembling and reused. The material is preferably polypropylene or polyethylene, since then the material is common including the sealing member 2.

Structure for the Rotational Driving

Figure 13B:
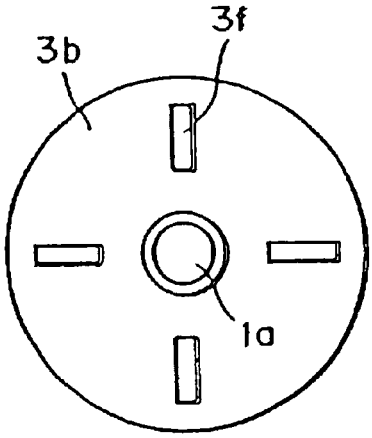
FIGS. 13(*a*) and 13(*b*) are schematic plan and side views of the driving force transmission portion of a toner supply container in accordance with the present invention, and show the structure thereof.
Figure 13A:
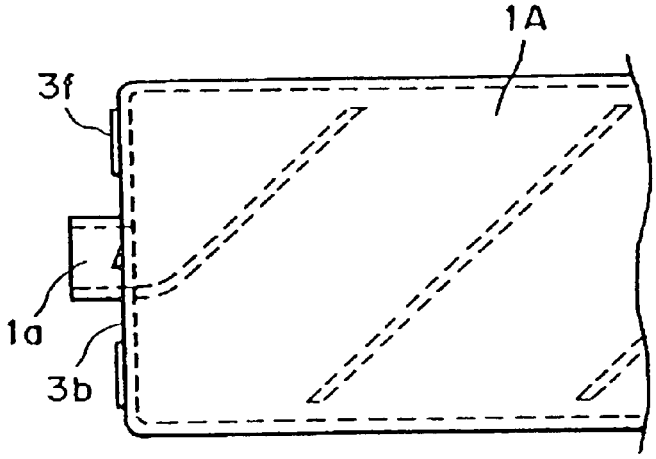
Figure 14B:
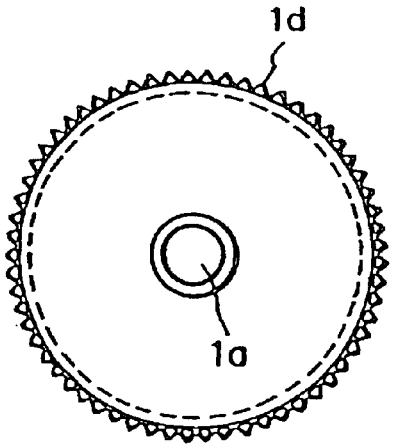
FIGS. 14(*a*) and 14(*b*) are schematic plan and side views of the driving force transmission portion of another toner supply container in accordance with the present invention, and show the structure thereof.
Figure 14A:
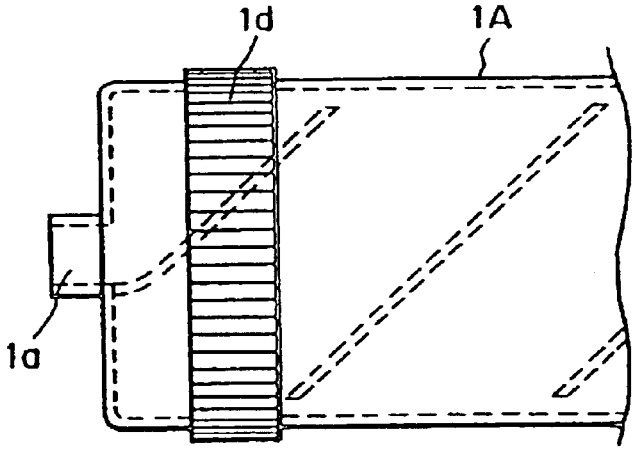

The description will be made as to the means for transmitting the driving force for rotating the main body 1A of the container. For this mean, various known mechanism is usable. FIGS. 13 and 14 shows an example.

In FIG. 13, a projection 3*f* is provided on the outer surface of the flange portion 3*b*, and it is engaged with a drive transmitting portion provided in the main assembly of image forming apparatus to receive the rotational driving force. FIG. 14 shows another example in which a gear portion 1*d* is formed around a circumference of the main body 1A, as shown in this Figure, by which the gear portion 1*d* is in meshing engagement with a driving gear provided in the main assembly of the image forming apparatus to receive the rotational driving force.

Figure 15:
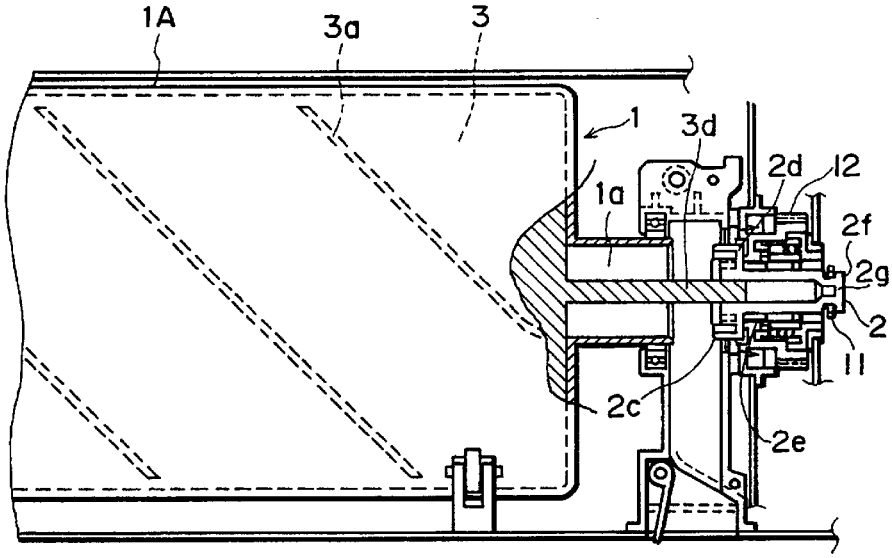
FIG. 15 is a schematic sectional view of another driving force transmission portion of a toner supply container in accordance with the present invention, and its adjacencies, as seen from the front side of the copying machine.

In the example shown in FIG. 15, the sealing member 2 functions also has a rotation driving force transmission member. The sealing member 2 comprises a sealing portion 2*c*, a flange portion 2*d*, a driving force receiving portion 2*e* and a locking portion 2*f*.

The outer diameter of the sealing portion 2*c* is slightly larger than the inner diameter of the opening 1*a*, and is press-fitted into the opening 1*a* until it is stopped by the flange portion 2*d*.

After the toner supply container 1 is loaded into the main assembly 100 of the image forming apparatus, in the locking part 11 is moved toward the center of the sealing member 2 by the opening and closing of the front door or the lever manipulation. The main body 1A of the container is moved to the left in the Figure, while the locking part 11 is engaged with the groove of the locking portion 2*f* of the sealing member 2, by which the sealing member 2 is automatically unplugged. When the toner is to be discharged from the container thus loaded in the main assembly, the rotational driving force is transmitted to the driving force receiving portion 2*e* of the sealing member 2 from the driving means 12 of the main assembly of the image forming apparatus. The sealing member 2 further comprises a non-circular shape shaft portion 3*d* integrally extended from the feeding member 3, and a corresponding rectangular hole 2*g* which is slidable in the direction of the axis for engagement with the shaft portion 3*d*. Even after the opening is unsealed, they are kept engaged with each other.

The toner is fed and discharged by transmitting the rotational driving force to the feeding member 3 and the main body 1A through the sealing member 2, the shaft portion 3*d* by which they are all together rotated.

When the toner supply container 1 is to be taken out, the operation is reverse. More particularly, the main body 1A of the container advances in response to opening of the front door or by manipulating the lever, by which the sealing member 2 is press-fitted into the opening 1*a* to reseal the opening 1*a*.

The sealing member 2 is preferably made by injection molding of plastic resin material, but may be produced through another method and/or from another material, or may be manufactured by assembling separate parts. The sealing member 2 is press-fitted into the toner supply opening 1*a* to seal it, and therefore, a proper degree of elasticity is required. The material is preferably polypropylene, Nylon, high density polyethylene or the like, and further preferably low density polyethylene.

Embodiment 2

Figure 16A:
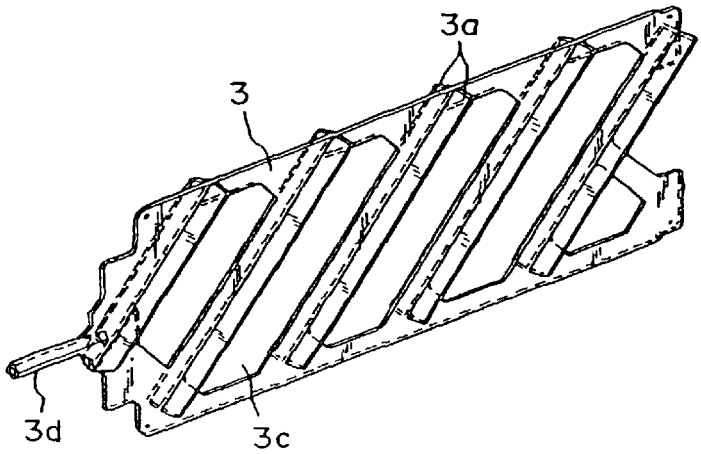
FIGS. 16(A), 16(B), and 16(C) are perspective view, side view, and plan view, of the toner supply container in the second embodiment of the present invention, in which the set of inclined ribs on one side of the conveying member and the set of inclined on the other side of the conveying member are disposed in mirror symmetry with respect to the toner conveying member.
Figure 16C:
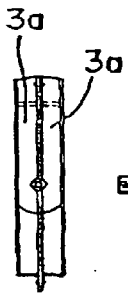
Figure 16B:
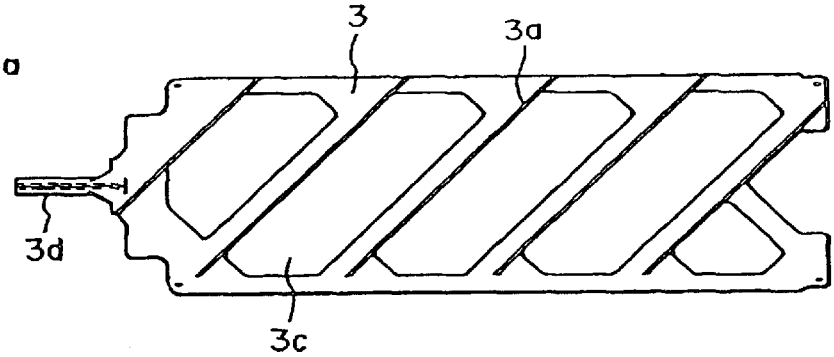

Referring to FIG. 16, the second embodiment will be described.

In FIG. 16, the inclined projections 3*a* on the opposite sides of the plate-like portions are in a mirror symmetry relationship with respect to a rotation axis a—a of the toner bottle 1A.

In a conventional example in which the toner is discharged by rotating the toner bottle 1A, the rotational direction of the toner bottle 1A is determined as being one direction, for discharging the toner (supply).

In the case of the conventional toner bottle having the helical rib on the inner surface of the toner bottle, the toner can be supplied only when the bottle is rotated in one predetermined direction.

However, in the case of the toner supply container 1 of this invention, the structure shown in FIG. 16 is possible in which the inclined projections 3*a* are arranged in a mirror symmetrical fashion. With this arrangement, the toner can be discharged by rotation in either direction.

Figures 17A, 17B, 17C:
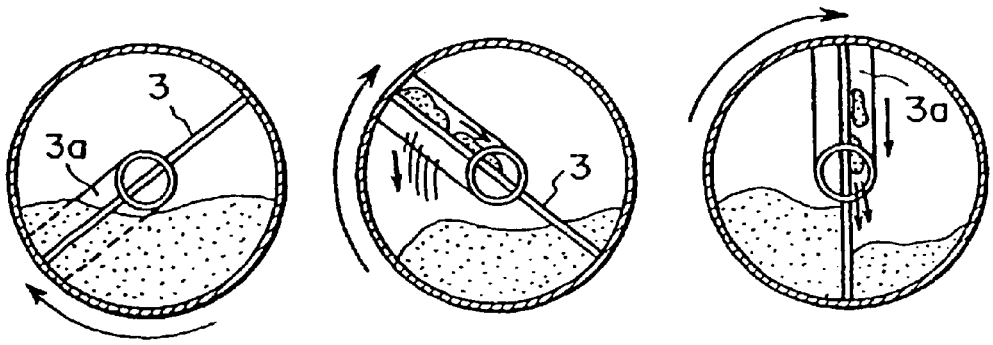
Figures 18A, 18B, 18C:
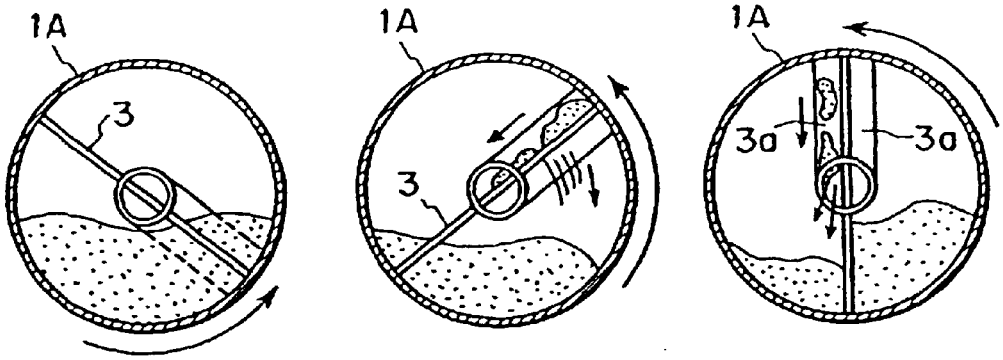
FIGS. 18(A), 18(B) and 18(C) are schematic sectional views of the toner supply container in the second embodiment of the present invention, which show how the toner in the container is discharged from the container, as the container is rotated in the counterclockwise direction.

FIG. 17 shows a case of clockwise rotation of the toner bottle 1A, and FIG. 18 shows a case of counterclockwise rotation of the toner bottle 1A.

In FIGS. 17, 18, the toner is scooped by the scooping or lift portion of the feeding member 3 through the steps shown by (a) and (b) of these Figures. The toner then slides down on the inclined projection 3*a* toward the opening (c).

As shown in these Figures, the inclined projections 3*a* are arranged in the mirror symmetrical fashion, the toner can be discharged with the rotational direction in either direction. However, the toner discharging operation occurs only once in one full rotation in either direction, as is different from first embodiment.

Using this arrangement, the following advantageous effects are provided.

By intermittently changing the rotational direction of the bottle and the feeding member, the impact (acceleration) upon the exchange is effective to drastically enhance the stirring effect for the toner in the container. Simultaneously, it is possible to drop the toner particles deposited on the inner surface of the bottle, and therefore, the amount of the unusably remaining toner can be drastically reduced.

Other Embodiments

The present invention is not limited to the above-described Embodiments, and various modifications are possible.

In the foregoing Embodiments, the inclined projection is extended substantially perpendicularly from the plate-like region, bought the inclined projection 3*a* may be modified as shown in FIG. 19 through FIG. 23.

Figure 19:
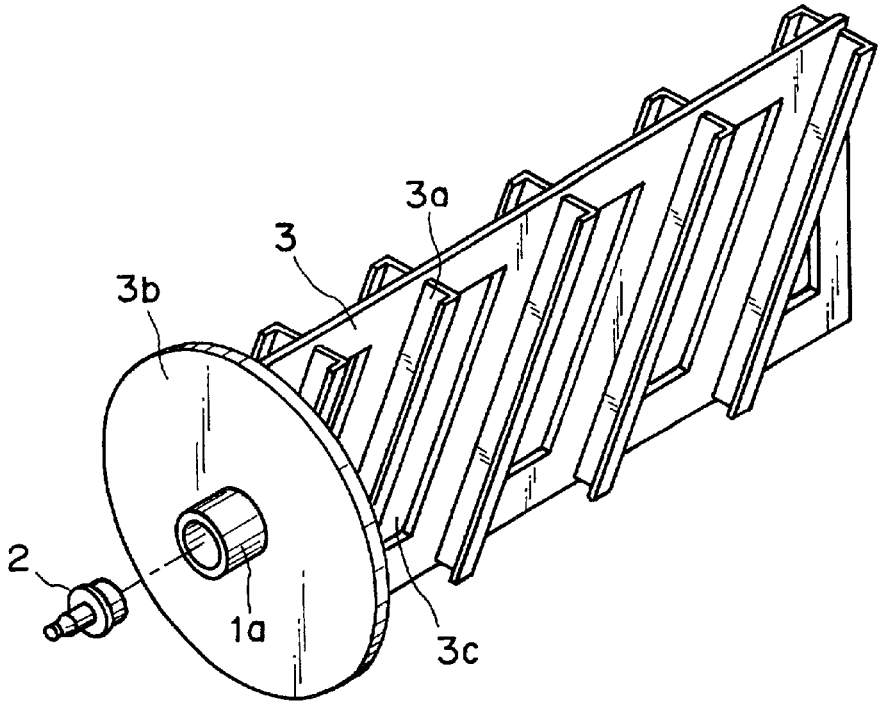
FIG. 19 is a perspective view of a toner conveying member different in the configuration of the inclined rib from the conveying members in the first and second embodiment.

In FIG. 19, the lateral end portion of the projection 3*a* is bent to "L" shape to fence the toner, by which the amount of the toner sliding on the inclined projection 3*a* is larger as compared with the foregoing embodiments.

Figure 20:
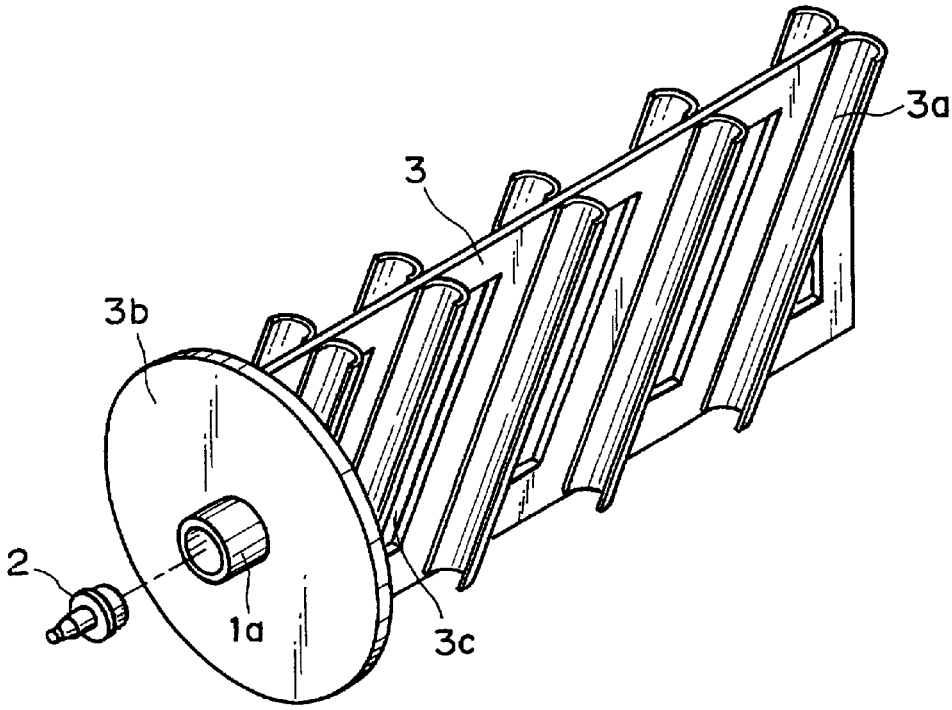
FIG. 20 is a perspective view of another toner conveying Member different in the configuration of the inclined rib from the conveying members in the first and second embodiments.
Figure 21:
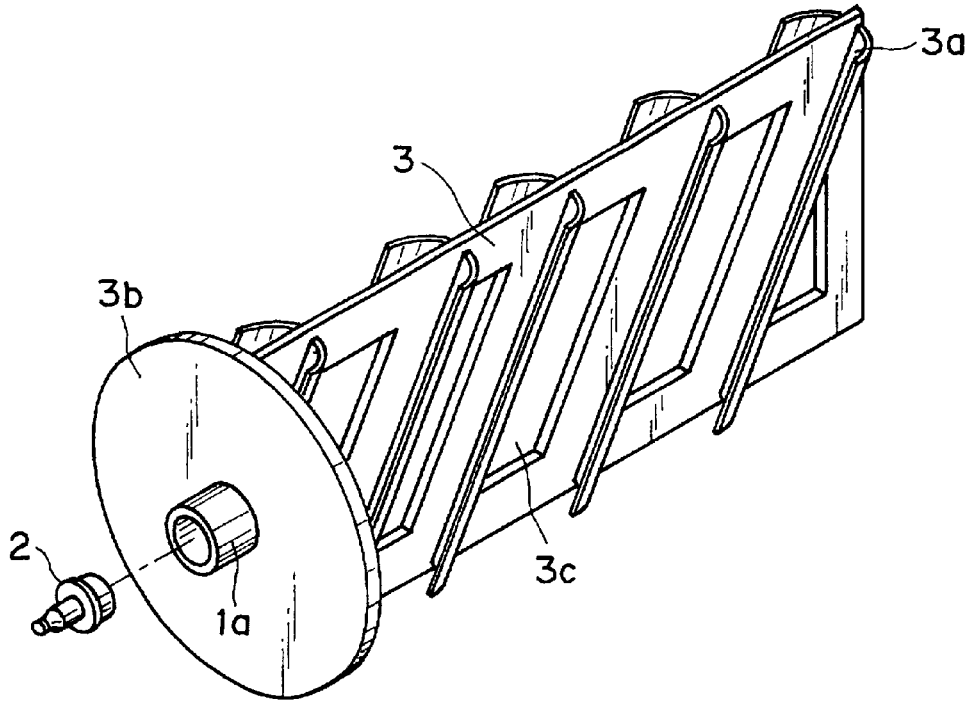
FIG. 21 is a perspective view of another toner conveying member different in the configuration of the inclined rib from the conveying members in the first and second embodiments.

FIGS. 20, 21 show other examples in which in the inclined projection 3*a* has a semicircular, elliptical or the like cross-section, that is, smoothly curved cross-section, by which the toner is assuredly held, therefore, the toner feeding force is enhanced. In addition, the amount of the toner deposited on the surface of the inclined projection 3*a* is reduced, by which the unusably remaining amount of the toner is reduced.

Figure 22:
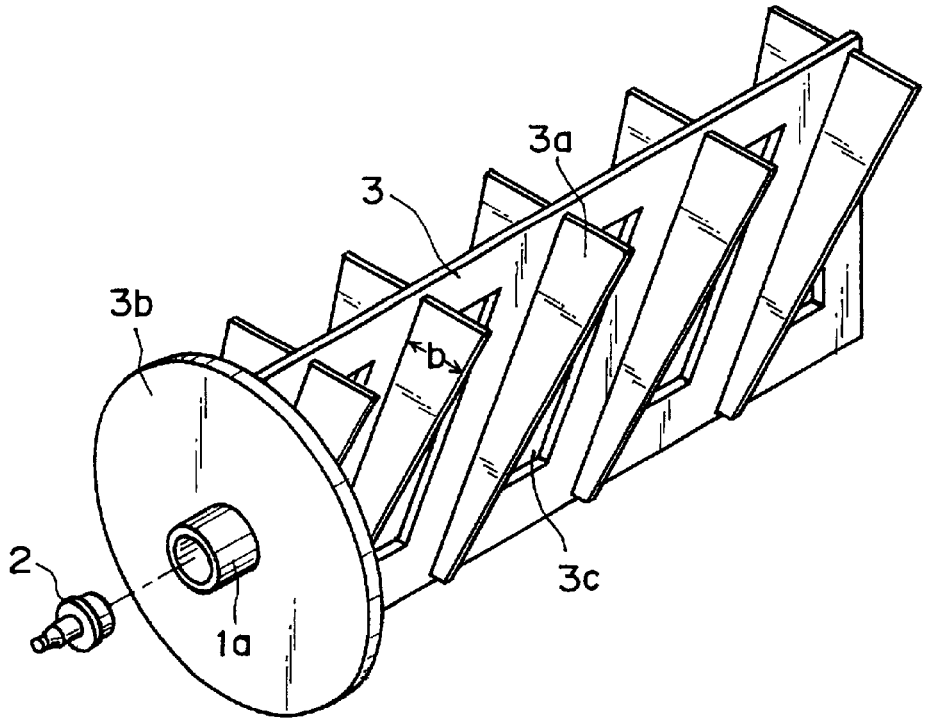
FIG. 22 is a perspective view of another toner conveying member different in the configuration of the inclined rib from the conveying members in the first and second embodiments.
Figure 23:
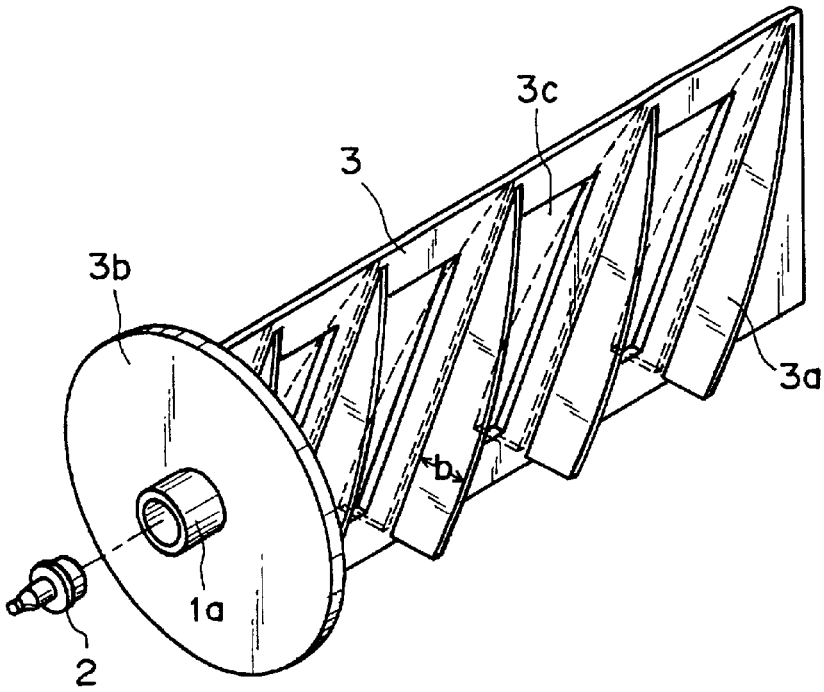
FIG. 23 is a perspective view of a toner conveying member different in the configuration of the inclined rib from the conveying members in the first and second embodiments.

As shown in FIGS. 22 and 23, in the width b of the inclined projection 3*a* is gradually changed (reduced or increased), by which the toner feeding amount can be adjusted. In the case of FIG. 22, in the upper part of the inclined projection is able to guide and feed a large amount of the toner, that in the lower part, a part of the toner is left fall rather than guided or fed. This is effective to enhance the toner stirring effect, and the amount of the toner feeding can be adjusted.

Because of the wide latitude in the design of the shape of the inclined projection 3*a*, the toner feeding amount can be properly set to provide a desire toner discharging property force.

Figure 24A:
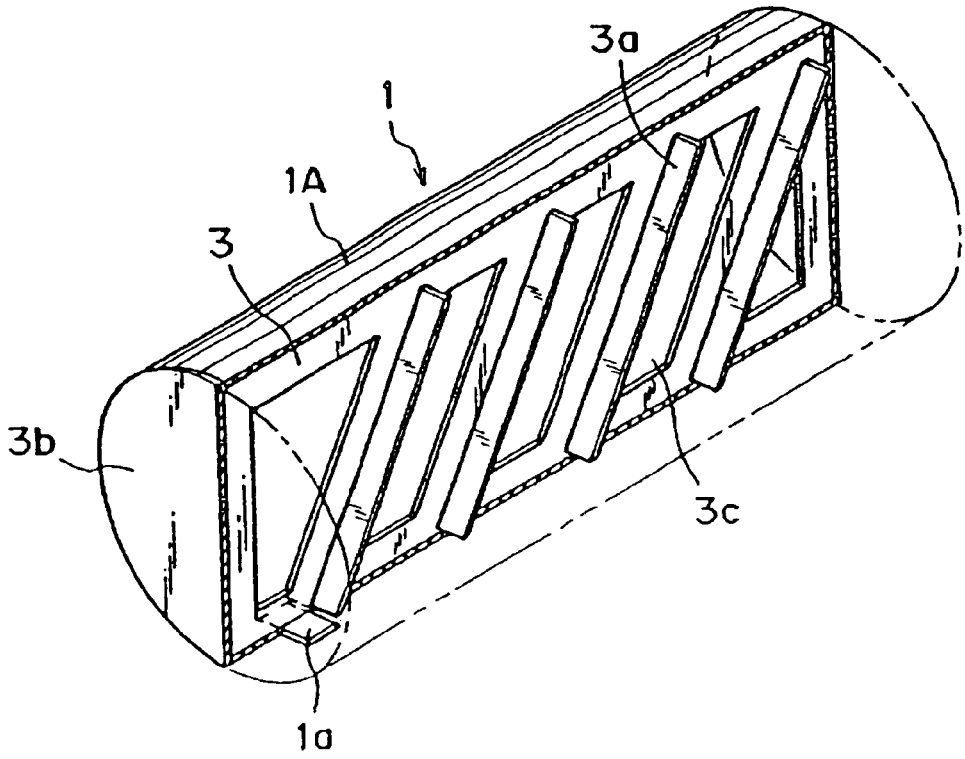
FIGS. 24(A) and 24(B) are perspective phantom view and sectional view, respectively, of the toner supply container in another embodiment of the present invention, the toner outlet of which is in the cylindrical wall of the container.
Figure 24B:
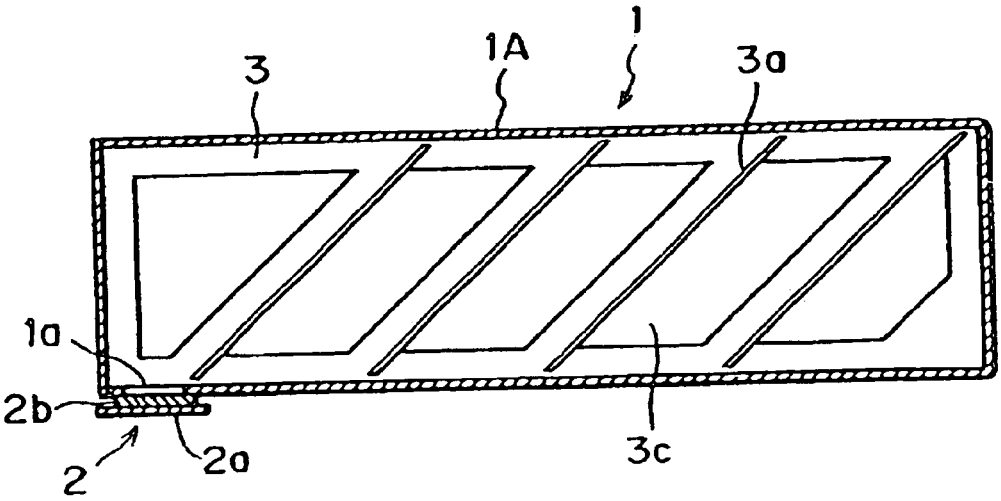

The position of the opening 1*a* through which the toner is discharged is not limited to the longitudinal end surface of the main body 1A of the container, but, as shown in FIG. 24, it may be disposed in the cylindrical surface of the main body.

In this case, the sealing member 2 considering the opening 1*a* comprises an arcuate shutter 2*a* conforming with the outer configuration of the main body 1A and a gasket 2*b* bonded to the inner surface of the shutter 2*a*.

The sealing member 2 is mounted on the main body 1A for reciprocation between a position for closing the opening 1*a* and a position for opening in the opening 1*a*. The mounting method may be such that rails parallel with the shutter 2*a* are provided, and correspondingly, parallel rail guide portions are provided around the opening 1*a* of the main body 1A so as to be engageable with the rails.

The directions of the reciprocation of the sealing member 2 may be of the peripheral surface of the main body 1A or color the rotation axis of the main body 1A. The latter is preferable because the sealing member 2 can be moved between the opening and closing directions using the motion of the sealing member 2 when the toner supply container 1 is mounted to or demounted from the main assembly along the rotation axis. For example, a hooking portion is provided below a mounting portion of the image forming apparatus so as to be engageable with the shutter. In interrelation with the mounting operation of the toner supply container, the shutter is automatically moved from the closing position to the opening position.

The gasket 2*b* is preferably made of polyurethane foam, and is fixed on the shutter 2*a* by a both sided adhesive tape. The gasket may be made of another material such as another foam material, rubber or another elastic member. It may be fixed by another known method. When the sealing member 2 is mounted to the main body of the container, the gasket 2*b* is compressed by a predetermined decree to hermetically seal the opening 1*a*.

The description will be made as to results of experiments on the toner discharging property of the toner supply container in the foregoing Embodiments.

Test 1

Into the toner supply container of the first embodiment (FIGS. 4–7), 2000 g of toner is filled, and the toner supply container was left placed vertically with the opening 1*a* at the bottom side for 40 days under a high temperature and high humidity ambience (temperature 40° C. and humidity 80%).

Then, the toner powder in the toner bottle has a very poor flowability because of moisture absorbed.

Because of the positioning under which the container is left, that is, the opening 1*a* at the bottom side, the toner is compressed at the bottom side due to the gravity. After placing under the harsh condition, the toner bottle was slowly loaded into the main assembly of the apparatus without shaking, and then was rotated at a predetermined rotational frequency (30 rpm). The toner bottle was rotated until all the toner is discharged, while the toner discharge was being measured at all times.

Figure 27:
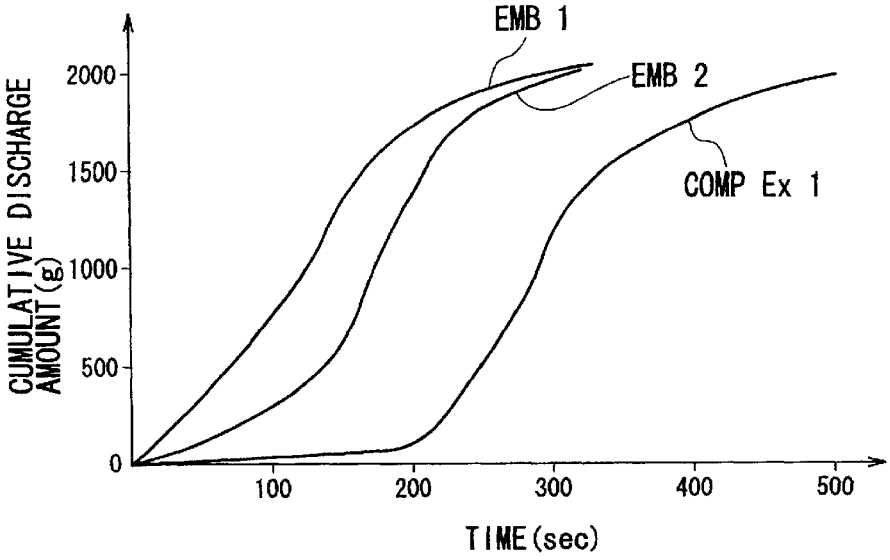
FIG. 27 is a graph which shows the toner discharge performances of the toner supply containers in the first and second embodiments, and the first comparative example.

FIG. 27 shows the results of the measured toner discharging amount. The ordinate is the cumulative toner discharging amount (g), and the abscissa is elapse of the time of toner discharging time (sec), that is, the time of bottle rotation (sec).

Test 2

Figure 25A:
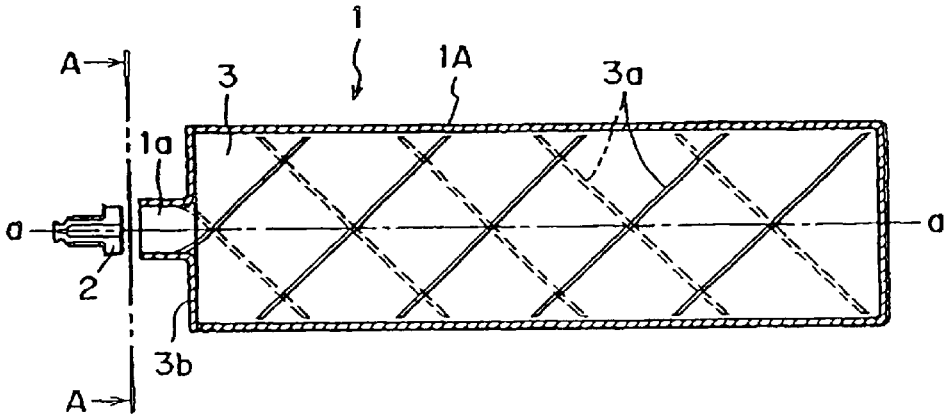
FIGS. 25(A) and 25(B) are sectional view, as seen from the front side of the copying machine, and plan view, as seen from the plane A—A in FIG. 8(A), of the toner supply container in the first comparative example of a toner supply container, the toner conveying member of which is not provided with holes.
Figure 25B:
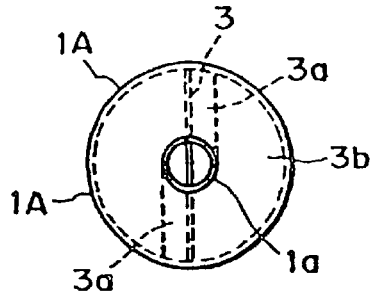
Figure 26:
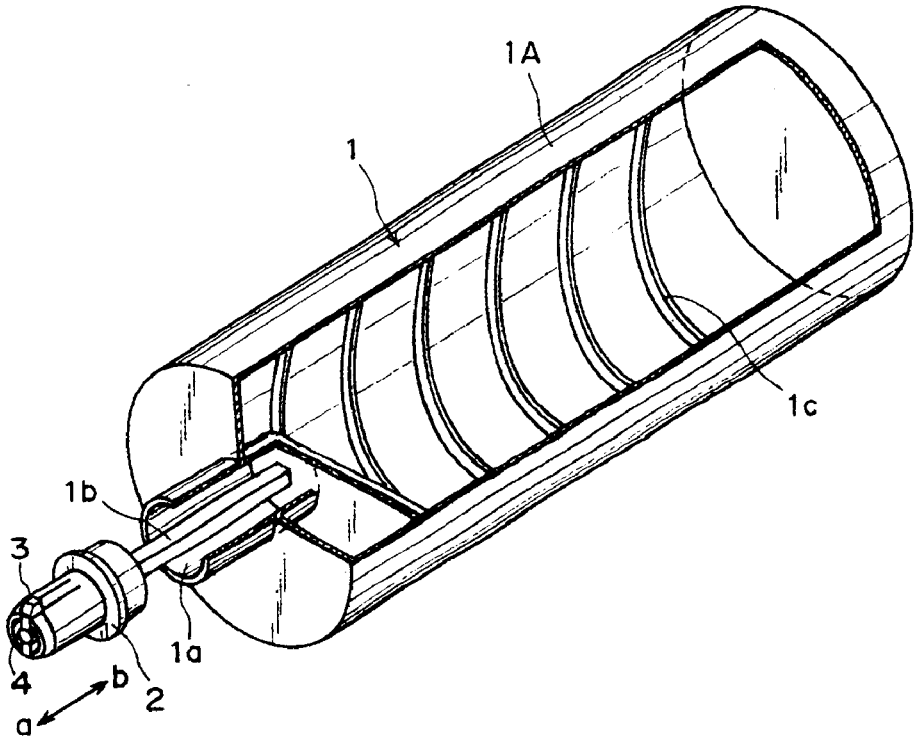
FIG. 26 is a partially broken perspective view of the toner supplying container in the second comparative example of a toner supply container in accordance with the prior arts, the internal surface of the main body of which is provided with a single spiral rib, or a plurality of spiral ribs, for describing the various structural components of the container.

As shown in FIG. 25, all of the hole portions 3*c* of the feeding member 3 is closed, so that inside of the bottle is substantially completely partitioned into to chambers. The same test was carried out under the same conditions. FIG. 27 shows the results of the measured toner discharging amount.

Structure of a Comparison Example 1

The same test was carried out under the same condition with respect to a toner bottle having a helical rib on the inside surface.

FIG. 27 also shows the results of the measured toner discharging amount.

As will be understood from FIG. 27, there is no problem from the initial stage of the rotation with respect to the toner bottle of test 1 in which the feeding member 3 is provided with hole portions 3*c*. Without the hole portions (test 2), the discharging property is slightly poor. More particularly, until about 150 sec, the discharging amount is slightly poor.

In the case of test 2, the inside of the bottle is completely partitioned, and therefore, the toner is unable to move across the feeding member. This significantly increase is the starting torque of the driving motor. There is a liability that driving motor may fail and may be required to exchange. To avoid this, it is necessary to use an extensive driving motor, which will lead to cost increase.

On the other hand, in the case of the comprising example, hardly any toner is discharged until about 200 sec at the initial stage, and of the toner is rotating together with the bottle. With continued rotation of the bottle, the toner starts to discharge at 200 sec elapse from the start.

It has been confirmed that in the tests 1 and 2, the collection be discharged from the beginning (initial stage of the rotation) even if the bottle is left under a harsh conditions and the toner in the bottle is bridged (the performance is poorer in test 2 than in test 2, though).

As described in the foregoing, according to the embodiments of the present invention, the following advantageous effects are provided.

(1) Since the number of parts constituting the toner bottle is small, and the number of assembling steps required a small, the manufacturing cost can be reduced.

(2) No bearing sealing mechanism is used unlike the conventional structure, the required rotational torque is small.

(3) No bearing sealing mechanism is used unlike the conventional structure, the liability of toner leakage can be reduced correspondingly.

(4) By selecting the configuration and arrangements of the projections from greater choice, the toner discharging amount and the discharging speed can be easily adjusted.

(5) A modification is easy to provide a container which can be rotated in the directions to discharge the toner.

(6) Since the feeding member is provided inside the main body of the container, the mechanical strength of the main body is reinforced, and the thickness of the main body of the container can be reduced.

(7) Even when the toner in the bottle contains large cake of particles, the toner can be properly discharged from the initial stage of the rotation.

(8) The constant amount discharging property can be provided.

(9) The main assembly of image forming apparatus can be downsize, and the cost of the driving unit for the toner supply container can be reduced.

(10) The used toner supply container can be easily recycled.

(11) Since the toner stirring power is high, the toner bridge is not produced in the main body of the container.

(12) Since the toner bottle does not have a helical rib on the inner side of the toner bottle, the manufacturing of the metal mold or molding using the metal mold are simple and easy.

While the invention has been described with reference to the structures disclosed herein, it is not confined to the details set forth and this application is intended to cover such modifications or changes as may come within the purpose of the improvements or the scope of the following claims.

What is claimed is:

1. A toner supply container detachably mountable to an image forming apparatus, said toner supply container comprising:

a container body for containing toner, said container body being provided with an opening portion for permitting discharge of the toner therefrom; and a feeding member, provided in said container body, for feeding the toner in said container body toward said opening portion, wherein said feeding member includes a rotatable plate-like member extending in a longitudinal direction of said container body, said plate-like member including a projection, extending at an incline relative to a rotational axis of said plate-like member to guide the toner toward said opening portion with rotation of said plate-like member and a through-hole effective to allow the toner on said plate-like member to fall with rotation of said plate-like member, thus stirring the toner.

2. A toner supply container according to claim 1, wherein a plurality of such projections are provided at longitudinally different positions on one side of said plate-like member.

3. A toner supply container according to claim 1, wherein a plurality of such projections are provided at longitudinally different positions on both sides of said plate-like member.

4. A toner supply container according to claim 3, wherein said plurality of projections are provided on both sides of said plate-like member so as to effect a toner discharging action twice for one full rotation of said plate-like member.

5. A toner supply container according to any one of claims 2, 3, and 4, wherein one of said plurality of projections is substantially close to or contiguous with said opening portion.

6. A toner supply container according to any one of claims 2, 3, and 4, wherein said plurality of such projections are provided so as to be partly overlapped with respect to a longitudinal direction of said plate-like member.

7. A toner supply container according to any one of claims 2, 3, and 4, wherein said plurality of said projections are provided, and said through-hole is provided between each of adjacent ones of said projections.

8. A toner supply container according to any one of claims 2, 3, and 4, further comprising a hollow extension extending from said opening portion, said extension having an opening at a free end thereof to permit discharge of the toner.

9. A toner supply container detachably mountable to an image forming apparatus, the toner supply container comprising:

a rotatable container body for containing toner, said container body being provided with an opening portion for permitting discharge of the toner therefrom; and a feeding member, provided in said container body, for feeding the toner in said container body toward said opening portion by integral rotation thereof with said container body, wherein said feeding member includes a rotatable plate-like member extending in a longitudinal direction of said container body, said plate-like member including a projection, extending at an incline relative to a rotational axis of said plate-like member to guide the toner toward said opening portion with rotation of said plate-like member and a through-hole effective to allow the toner on said plate-like member to fall with rotation of said plate-like member, thus stirring the toner.

10. A toner supply container according to claim 9, wherein a plurality of such projections are provided at longitudinally different positions on one side of said plate-like member.

11. A toner supply container according to claim 9, wherein a plurality of such projections are provided at longitudinally different positions on both sides of said plate-like member.

12. A toner supply container according to claim 11, wherein said plurality of projections are provided on both sides of said plate-like member so as to effect toner discharging action twice for one full rotation of said plate-like member.

13. A toner supply container according to any one of claims 10 through 12, wherein one of said plurality of projections is substantially close to or contiguous with said opening portion.

14. A toner supply container according to any one claims 10 through 12, wherein said plurality of projections are provided so as to be partly overlapped with respect to a longitudinal direction of said plate-like member.

15. A toner supply container according to any one of claims 10 through 12, wherein said plurality of projections are provided, and said through-hole is provided between each of adjacent ones of said plurality of projections.

16. A toner supply container according to claim 13, further comprising a hollow extension from said opening portion, said extension having an opening at a free end thereof to permit discharge of the toner.

17. A toner supply container according to claim 9, wherein the container is substantially cylindrical.

18. A toner supply container according to claim 9, wherein said plate-like member is disposed so as to be close to or in contact with an inside peripheral surface of said container body.

19. A toner supply container according to claim 9, wherein said plate-like member extends substantially along a full length of said container body.

20. A toner supply container according to claim 9, wherein said plate-like member diametrically divides an inside of said container body into two substantially equal parts.

* * * * *

UNITED STATES PATENT AND TRADEMARK OFFICE

CERTIFICATE OF CORRECTION

PATENT NO. : 7,039,347 B2
APPLICATION NO. : 10/076455
DATED : May 2, 2006
INVENTOR(S) : Yusuke Yamada et al.

It is certified that error appears in the above-identified patent and that said Letters Patent is hereby corrected as shown below:

ON THE TITLE PAGE

At Item (30), Foreign Application Priority Data, "2001/042536" should read --2001-042536--; and "2001/174179" should read --2001-174179--; and At Item (56) Foreign Patent Documents, "JP 10/339993 12/1998" should read --JP 10-339993 12/1998--.

COLUMN 1

Line 56, "above described" should read --above-described--.

COLUMN 2

Line 7, "discharge" should read --discharged--; and
Line 56, "above described" should read --above-described--.

COLUMN 3

Line 2, "above described" should read --above-described--;
Line 7, "problem," should read --a problem,--; and
Line 13, "above described" should read --above-described--.

COLUMN 4

Line 65, "Member" should read --member--.

COLUMN 8

Line 34, "substantially" should read --substantial--; and
Line 44, "is" should read --as--.

COLUMN 9

Line 65, "assure" should read --assured--.

UNITED STATES PATENT AND TRADEMARK OFFICE

CERTIFICATE OF CORRECTION

PATENT NO. : 7,039,347 B2
APPLICATION NO. : 10/076455
DATED : May 2, 2006
INVENTOR(S) : Yusuke Yamada et al.

It is certified that error appears in the above-identified patent and that said Letters Patent is hereby corrected as shown below:

COLUMN 11

Line 15, “slides” should read --slide--;

Lines 27-30, “By doing so, it can be avoided the toner lifted by the inclined projection overtakes the immediately front side inclined projection due to the inertia of the toner sliding down on the inclined projection.” should read --By doing so, it can be avoided that the toner lifted by the inclined projection, which falls and is going to pass under the immediately front side inclined projection due to the inertia of the toner sliding down on the inclined projection, is blocked.--;

Line 47, “necessary” should read --necessarily--; and

Line 65, “Gs” should read --θs--.

COLUMN 14

Line 8, “easy” should read --easily--; and

Line 43, “has” should read --as--.

COLUMN 16

Line 7, “bought” should read --but--;

Line 14, “in” (second occurrence) should be deleted;

Line 25, “in” (second occurrence) should be deleted; and “fall rather” should read --to fall rather than be:--; and Line 33, “desire” should read --desired--.

COLUMN 17

Line 57, “increase is” should read --increases--; and

Line 65, “of” should be deleted.

UNITED STATES PATENT AND TRADEMARK OFFICE

CERTIFICATE OF CORRECTION

PATENT NO. : 7,039,347 B2
APPLICATION NO. : 10/076455
DATED : May 2, 2006
INVENTOR(S) : Yusuke Yamada et al.

It is certified that error appears in the above-identified patent and that said Letters Patent is hereby corrected as shown below:

COLUMN 18

Line 10, "a" should read --are--; and
Line 31, "downsize," should read --downsized,--.

Signed and Sealed this

Fifteenth Day of May, 2007

JON W. DUDAS
*Director of the United States Patent and Trademark Office*